US011274507B1

(12) United States Patent
Gordey et al.

(10) Patent No.: US 11,274,507 B1
(45) Date of Patent: Mar. 15, 2022

(54) ROD JACK APPARATUS

(71) Applicant: NewKota Services and Rentals, LLC, Minot, ND (US)

(72) Inventors: Ken Gordey, Esteven (CA); Mark Ziegler, Minot, ND (US); Rob Foster, Calgary (CA); Kent Kirkhammer, Minot, ND (US); Real Mercier, Douglas, ND (US); Jarod Seifert, Burlington, ND (US)

( * ) Notice: Subject to any disclaimer, the term of this patent is extended or adjusted under 35 U.S.C. 154(b) by 0 days.

(21) Appl. No.: 16/997,548

(22) Filed: Aug. 19, 2020

(51) Int. Cl.
*E21B 43/12* (2006.01)
*E21B 19/12* (2006.01)

(52) U.S. Cl.
CPC ..... *E21B 19/12* (2013.01); *E21B 43/127* (2013.01)

(58) Field of Classification Search
CPC ..... E21B 19/12; E21B 43/127
See application file for complete search history.

(56) References Cited

U.S. PATENT DOCUMENTS 3,331,585 A * 7/1967 Dubberke ..... E21B 19/00 254/31
4,209,066 A * 6/1980 Watson ..... E21B 19/06 166/377
4,476,936 A * 10/1984 Boyadjieff ..... E21B 19/00 166/383
4,890,671 A * 1/1990 Baxter ..... E21B 19/06 166/250.01
5,704,427 A * 1/1998 Buck ..... E21B 15/02 166/338
6,009,941 A 1/2000 Haynes
6,209,633 B1 4/2001 Haynes
7,210,525 B2 * 5/2007 Dallas ..... E21B 33/068 166/77.4
9,702,214 B2 7/2017 Turner
10,138,689 B2 11/2018 Gordey et al.
2015/0114670 A1 4/2015 Turner
2016/0102534 A1 * 4/2016 Marshall ..... E21B 43/126 166/377
2016/0305200 A1 10/2016 Gordey et al.
2019/0055794 A1 2/2019 Gordey et al.

* cited by examiner

*Primary Examiner* — Taras P Bemko
(74) *Attorney, Agent, or Firm* — Antoinette M. Tease

(57) ABSTRACT

The present invention is a rod jack apparatus with four vertical legs that form a framework and first and second lower brackets connected to the vertical legs. Two hydraulic cylinders extend upwardly from the lower brackets, pass through a first horizontal plate, and are connected to a second horizontal plate. A primary clamping mechanism is situated on top of each of the two horizontal plates, and a secondary clamping mechanism is attached to the underside of each horizontal plate. The apparatus is configured to received a polished rod, and the primary and secondary clamping mechanisms are configured to grip the polished rod when activated. The sucker rod assembly is lifted out of the well when the first and second hydraulic cylinders are extended. The invention includes a method of using the apparatus described herein.

11 Claims, 33 Drawing Sheets

ROD JACK APPARATUS

BACKGROUND OF THE INVENTION

1. Field of the Invention

The present invention relates generally to the field of oil and gas production, and more particularly, to a rod jack apparatus for installing, removing and servicing oil and gas wells equipped with artificial lift sucker rod assemblies.

2. Description of the Related Art

Most oil wells require a mechanical means to produce. Artificial lift is a process used on oil wells to increase pressure within die reservoir and encourage oil to the surface. The artificial lift system consists of a surface unit and a sucker rod assembly with a positive displacement pump placed at near the bottom of the well. The sucker rod assembly is a series of sucker rods (steel rods that are typically between 25 and 30 feet (seven to nine meters) in length and threaded at both ends) that are joined together to form a single, vertical "string" of rods, the top most of which is referred to as the "polished" rod. As explained in Schlumberger's Oilfield Glossary, the polished rod is "the uppermost joint in the string of sucker rods used in a rod pump artificial-life system. The polished rod enables an efficient hydraulic seal to be made around the reciprocating rod string." According to Schlumberger, the "rod string" is "an assembled length of sucker rods used to connect and power a rod pump with the reciprocating power source at [the] surface."

As noted above, the sucker rod assembly is connected to the bottom hole pump, which is seated in a seating profile located at the bottom of the well production tubing. The positive displacement pump is connected to the sucker rod string and either strokes (up/down) or is rotated (depending on pump type) to create a displacement pressure on the tubing and deliver the fluids within the well (oil/gas/water) to the surface. In order to flush fluid/gas down the tubing, the pump must be unseated. Typically, this involves the removal and re-installation of the entire rod assembly at high cost and significant down time before production can resume.

The present invention facilitates a number of different types of well interventions-including well suspensions, shutting down of low production wells, offset well protection, interventions due to low production wells, and well maintenance and repairs—by making it possible to conduct these operations without completely removing the sucker rod assembly. Each of these different types of well interventions is discussed below.

Well suspensions are required for many well operations in which environmental protection is the focus. To properly secure the well, the wellhead must be fully closed, and the well must be inhibited against corrosion. In order to accomplish this task, the downhole pump must be unseated. With the present invention, the downhole pump can be unseated by lifting the rod assembly without fully removing it from the well.

Low production wells are shut in until the economics improve. Current procedures involve the removal of the sucker rod system and the suspension of the well, which is expensive and entails high re-activation costs due to capital cost equipment requirements. This process often results in abandonment of marginally producing wells because of the costs associated with reactivation once the rod assembly has been removed from the well. With the present invention, low production wells can be shut down without removing the entire rod assembly. As a practical matter, removal of the rod assembly for any significant period of time will require complete replacement of the rod assembly.

Offset well protection during oil well completion fracturing operations is a sector of the oil industry that has developed due to reservoir communication during operations.

During infill frack completion operations, offset wells that are affected when communication is achieved during the frack operations require protection from high-pressure communications. Service rig units are deployed to install and setup the wells with high-pressure wellhead systems to prevent any environmental damage, and sucker rod assemblies are pulled or dropped in the well, requiring fishing or high re-installation costs and downtime in order for production to resume. Upon completion of the frack operations, the wellhead assembly must be replaced, the rod assembly must be installed, and the well must be flushed. It takes an average of three days per well for decommissioning and resetting up of the well. The present invention facilitates this process by eliminating the need to remove the entire rod assembly from the well to replace the production wellhead with a high-pressure wellhead or to flush the well with chemicals.

As new well production changes, problems associated with production declines become apparent. These problems include the presence of solids, wax paraffins and sands in the oil stream, as well as scale caused from water production characteristics. Often chemical treatments are used to address these issues, at least temporarily, and service rigs are used to remove the rod assembly from the well to facilitate this process. With the present invention, these chemical treatments can be made without pulling the entire rod assembly out of the well, which greatly reduces the costs associated with the intervention.

Well repairs are an ongoing and routine problem. Production wells are affected by well fluid problems (e g., scale, solids and sand) that require constant maintenance and repairs. Various well head components may require repair, and the polished rod periodically needs to be replaced. Maintenance usually requires that the well be flushed with fluids (chemical treatments) or that the pump be serviced and/or replaced. All of these activities currently require removal of the entire rod assembly from the well, whereas the present invention enables these procedures to be conducted with the sucker rod assembly suspended within the well.

The conventional equipment used to perform well interventions is a mast unit, which consists of a mast (in lieu of a crane or gin pole) and a pulling tool. Mast units typically requires the rental of additional equipment and the use of a four-man crew. Operations using this type of equipment are costly, slow to execute and schedule, and involve the removal of the entire sucker rod assembly from the well. Afler the sucker rod assembly is removed from the Well, the service operation is completed, and the rod assembly is re-installed. An average operation takes about three days to complete. The present invention is a stand-alone unit requires only two people to operate, and significantly reduces the time required to undertake a well intervention.

The oil industry is constantly seeking new technologies and procedures to perform routine maintenance and well intervention work to optimize production. The present invention is a portable system for removing an artificial lift sucker rod assembly that is easy to install, easy to transport, and easy to use. The present invention fundamentally changes the economics of well operations, resulting in reduced operating costs and a more efficient production process. The present invention is structurally distinct from anything in the prior art. The following references are discussed for general background.

U.S. Pat. Nos. 6009941 (Haynes, 2000) and 6209633 (Haynes, 2001) disclose an apparatus for axially displacing a downhole tool or a tubing string a wellbore. The downhole tool is supported by a tubing string with a telescoping joint, the tubing string being situated in the well. A lifting mechanism is connected to a lift rod string, which engages a latch point in the telescoping joint. The apparatus permits the downhole tool to be displaced within a range constrained by the length of the telescoping joint. The apparatus includes a tool entry spool adapted to be mounted to a top of the wellhead and at least one annular seal for containing well pressure that is mounted above the tool entry spool and provides a fluid seal around a periphery of the lift rod string. This apparatus is very different than the present invention in that the present invention straddles the entire wellhead assembly, whereas the Haynes invention is mounted on top of and seals the wellhead.

U.S. Pat. No. 9,702,214 (Turner, 2017) discloses a cap for sealing a wellhead assembly and suspending well assets (e.g., tubing, rods, etc.) within the well from the cap to facilitate production at the well after a period of abandonment. Ends of a tubing string and a rod string disposed within the well are secured within portions of the cap. The cap is placed and secured over the exposed casing head.

U.S. patent Ser. No. 10/138,689 (Gordey et al., 2018) discloses a tool and method for use in supporting a sucker rod string in an oil or gas well driven by an artificial lift. The tool includes a body having a lower narrow portion dimensioned to fit within the interior cavity of a tubing string inlet or an upper extension thereof, an upper wide diameter portion defining a substantially horizontal landing surface dimensioned to rest upon the top edge of the tubing string inlet or the upper extension thereof, one or more sucker rod-engaging structures, and one or more longitudinal slots extending through the lower narrow portion and the upper wide diameter portion to allow passage of fluid or gas through the tool when it is supported on the top edge of the tubing string inlet or the upper extension thereof. The sucker-rod engaging elements may be configured as a longitudinal cavity and slot or as grooves to facilitate clamping of the support tool to the sucker rod, or they may be threaded to receive a sucker rod connector.

BRIEF SUMMARY OF THE INVENTION

The present invention is a rod jack apparatus comprising: two vertical left legs and two vertical right legs configured to form a framework, each of the two vertical left legs and the two vertical right legs having an upper end; a first lower bracket situated horizontally between and connected to the two vertical left legs; a second lower bracket situated horizontally between and connected to the two vertical right legs; a first hydraulic cylinder extending upwardly from the first lower bracket; a second hydraulic cylinder extending upwardly from the second lower bracket; a first horizontal plate; a second horizontal plate; wherein each of the first and second hydraulic cylinders has a top end that passes through an aperture in the first horizontal plate and is fixedly attached to the second horizontal plate; wherein each of the first and second horizontal plates comprises a primary clamping assembly situated on top of the first or second horizontal plate and a secondary clamping assembly situated directly underneath the first or second horizontal plate; wherein the primary clamping assembly comprises a first pair of hydraulic cylinders oriented parallel to each other and situated on a left side of the first or second horizontal plate and a second pair of hydraulic cylinders oriented parallel to each other and situated on a right side of the first or second horizontal plate; wherein each hydraulic cylinder in the first or second pair of hydraulic cylinders on the right or left side of the first or second horizonal plate is mechanically coupled via one or more linkages to a first die having a front surface with a concave section, the first die being configured to clamp around the polished rod when the hydraulic cylinders are extended; and wherein the secondary clamping assembly comprises a C-plate configured to receive a polished rod and at least two hydraulic cylinders arranged radially around a center of the C-plate.

In a preferred embodiment, the invention further comprises: a first upper bracket that is situated horizontally between and connected to the upper ends of the two vertical left legs; and a second upper bracket that is situated horizontally between and connected to the upper ends of the two vertical right legs; wherein the second horizontal plate has left and right ends that are supported by the first and second upper brackets, respectively. Preferably, a second die having a front surface with a concave section is attached to a distal end of a piston rod of each of the at least two hydraulic cylinders of the secondary clamping assembly. Each of the first and second horizontal plates preferably comprises: a central channel that extends from a front to a center of the first or second horizontal plate; and a front recess that spans the central channel and is configured to receive a removable bracket.

In a preferred embodiment, the invention further comprises a first platform situated directly on top of the first horizontal plate and a second platform situated directly on top of the second horizontal plate; wherein each of the first and second platforms is configured to move from a first position relative to the first or second horizontal plate to a second position relative to the first or second horizontal plate; wherein when the platform is in the second position, the platform is closer to the polished rod than when the platform is in the first position; wherein each first die resides within a die housing; wherein the one or more linkages are configured so that the first die and die housing tilt forward toward the polished rod and the platform moves from the first position to the second position when the primary clamping assembly is activated; and wherein a first spring pushes the platform back to the first position when the primary clamping mechanism is inactivated. Preferably, the concave section on the front surface of the first die has a first radius and a second radius, and the first radius is greater than the second radius. Preferably, the concave section on the front surface of the first die comprises: a plurality of parallel grooves extending laterally across an inside surface of the concave section; and two parallel grooves extending longitudinally from a bottom of the first die to a top of the first die along the inside surface of the concave section.

In a preferred embodiment, the invention further comprises a second spring that is situated inside the die housing and configured to bias the first die in an upward position when the first die is inserted into the die housing. Preferably, the first die comprises a rear wall; wherein the front surface of the first die comprises a flat section on either side of the concave section; and wherein the rear wall of the first die is at an eighteen-degree angle relative to the flat section of the front surface of the first die. The die housing preferably comprises a first lip along a right front edge of the die housing and a second lip along a left front edge of the die housing; each of the first and second lips extending inward to form a channel; wherein the first die comprises right and left rear wings; wherein the first and second lips on the die housing and configured to receive the right and left rear wings on the first die; wherein the die housing further comprises a bottom beveled edge; and wherein the first and second lips are shorter than the right and left wings so as to form a gap between a bottom end of each of the first and second lips and the bottom beveled edge of the die housing.

The present invention is also a method of lifting a sucker rod assembly from a wellbore comprising the steps of: installing the rod jack apparatus of claim 1 over a wellbore; activating the primary clamping assembly on the second horizontal plate; activating the secondary clamping assembly on the second horizontal plate; extending the first and second hydraulic cylinders; activating the primary clamping assembly on the first horizontal plate; activating the secondary clamping assembly on the first horizontal plate; releasing the primary and secondary clamping assemblies on the second horizontal plate; retracting the first and second hydraulic cylinders; repeating steps (b) and (c); releasing the primary and secondary clamping assemblies of the first horizontal plate; and repeating steps (d) through (h).

REFERENCE NUMBERS

Figure 1:
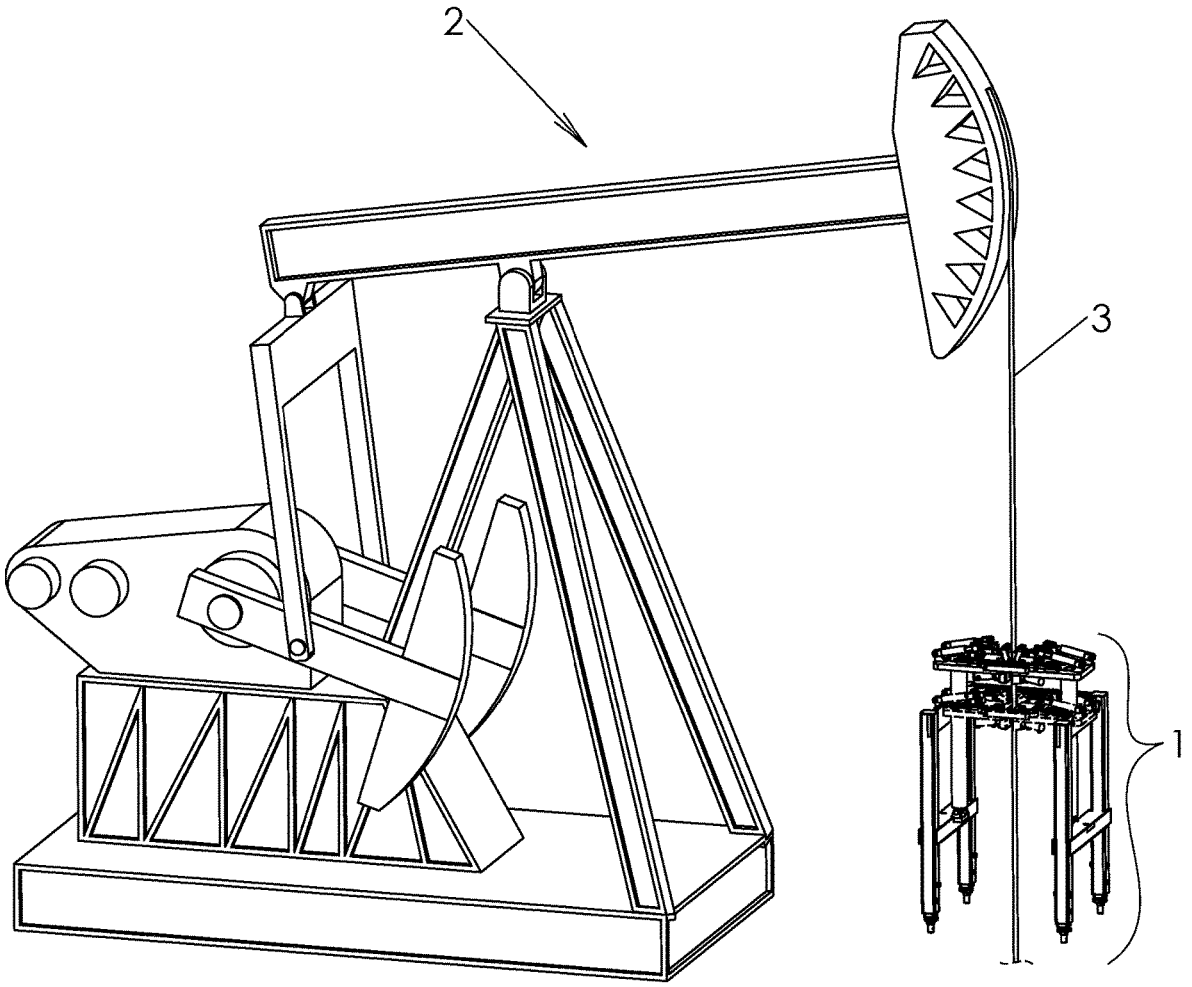
FIG. 1 is a perspective view of the present invention shown in relation to a pump jack.

1 Rod jack apparatus
2 Pump jack (prior art)
3 Polished rod (prior art)
4 Legs
4*a* Left legs
4*b* Right legs
5 First lower bracket
6 Second lower bracket
7 First hydraulic cylinder
8 Second hydraulic cylinder
9 First horizontal plate
10 Second horizontal plate
11 First upper bracket
12 Second upper bracket
13 Secondary clamping assembly
13*a* Hydraulic cylinders (of secondary clamping assembly)

14 Hydraulic cylinders (of primary clamping assembly)
15 Dies (of primary clamping assembly)
16 Primary clamping assembly
17 Gap (between bottom of die and top of platform on horizontal plate)
18 Gap (between top of hydraulic cylinder housing and bottom surface of second horizontal plate)
19 Platform (on horizontal plate)
20 First bracket
21 Main shaft
21*a* Protrusion (on main shaft)
22 Connecting bracket
23 Protrusions (on main shaft)
24 Second shaft
25 Connecting member
26 Third shaft
27 Die housing
28 Dolt
29 Front recess (in horizontal plate)
30 Bracket
31 Central channel (in horizontal plate)
32 Oval-shaped hole (in platform)
33 Spring
34 First vertical bracket
35 Second vertical bracket
36 Circular hole (in horizontal plate)
37 Concave section (of die)
38 Lateral grooves (in concave section of die)
39 Pins (on die housing)
40 Front surface (of die)
41 Body (of die)
42 Rear wings (of die)
43 Longitudinal grooves (in concave section of die)
44 Internal portion (of concave section of die)
45 Spring
46 Rear wall (of die)
47 C-plate
48 C-plate adapter
49 Dies (of secondary clamping assembly)
50 Pin
51 Wellhead (prior art)
52 Feet (on vertical legs)
53 Upright collar
54 Framework
55 Well casing (prior art)
56 Rearward extension (on die 15)
57 Downhole pump
58 Pump housing
59 Downhole seal assembly
60 Support bracket
61 Ceiling member
62 Screws
63 Lips
64 Beveled edge
65 Gap
66 Triangle-shaped member

DETAILED DESCRIPTION OF INVENTION

FIG. 1 is a perspective view of the present invention shown in relation to a pump jack. This figure shows the rod jack apparatus 1, the pump jack 2, and the polished rod 3 around which the rod jack apparatus is centered. To install the rod jack apparatus 1 on-site, the apparatus is temporarily secured to and lifted by a crane (not shown) and then lowered by the crane and situated over the wellhead, where it is temporarily secured to a framework directly on top of the wellhead (see FIG. 3). The pump jack 2 is connected to the sucker rod assembly (described below), and the present invention may be used while the pump jack remains in place. It is important to note that the present invention straddles the well and does not connect to any part of the wellhead assembly.

Figure 2:
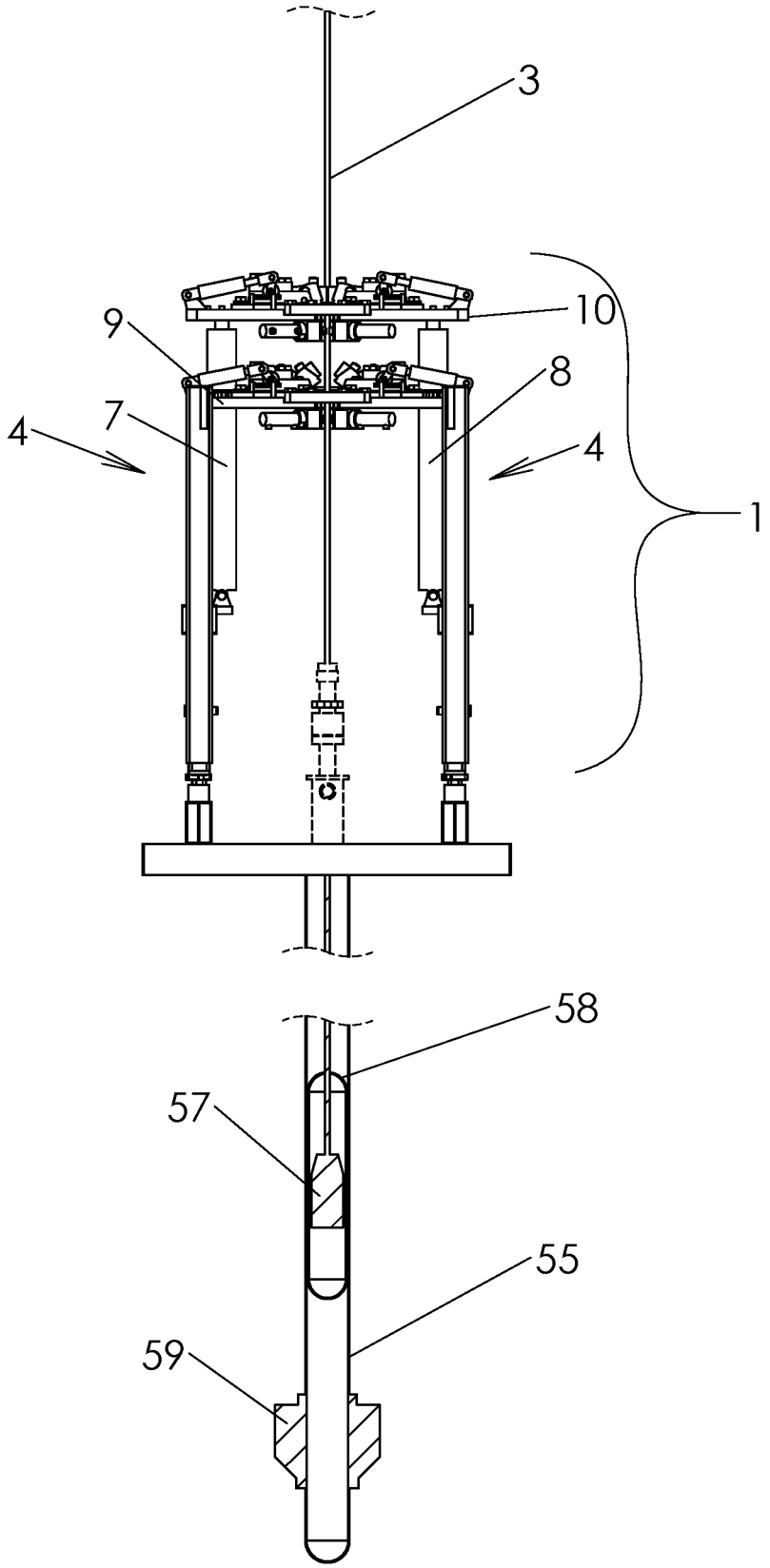
FIG. 2 is a front view of the present invention installed on top of a wellhead.

FIG. 2 is a front view of the present invention installed on top of a wellhead. The wellhead 51 in this figure is illustrated in broken lines and is not part of the present invention. This figure also shows the downhole pump 57, pump housing 58 and downhole seal assembly 59, which creates a seal against the well casing 55. None of these components is a part of the present invention.

Figure 3:
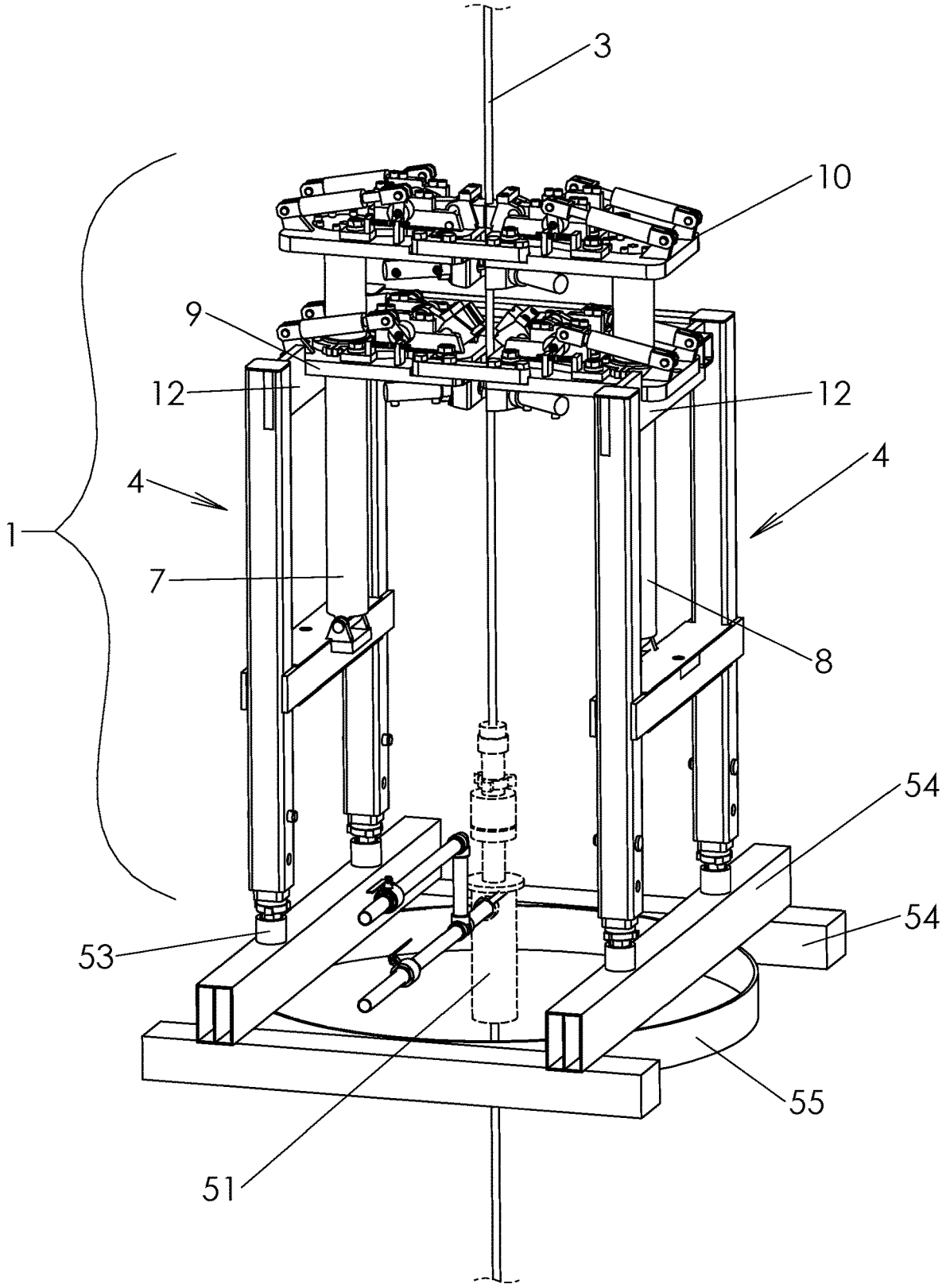
FIG. 3 is a perspective view of the present invention situated on top of a wellhead.

FIG. 3 is a perspective view of the present invention situated on top of a wellhead. The wellhead 51 in this figure is illustrated in broken lines and is not part of the present invention. As shown in this figure, the feet 52 on the distal ends of the vertical legs 4 (see FIG. 4) are inserted into upright collars 53 on a framework 54 that straddles the well casing 55.

Figure 4:
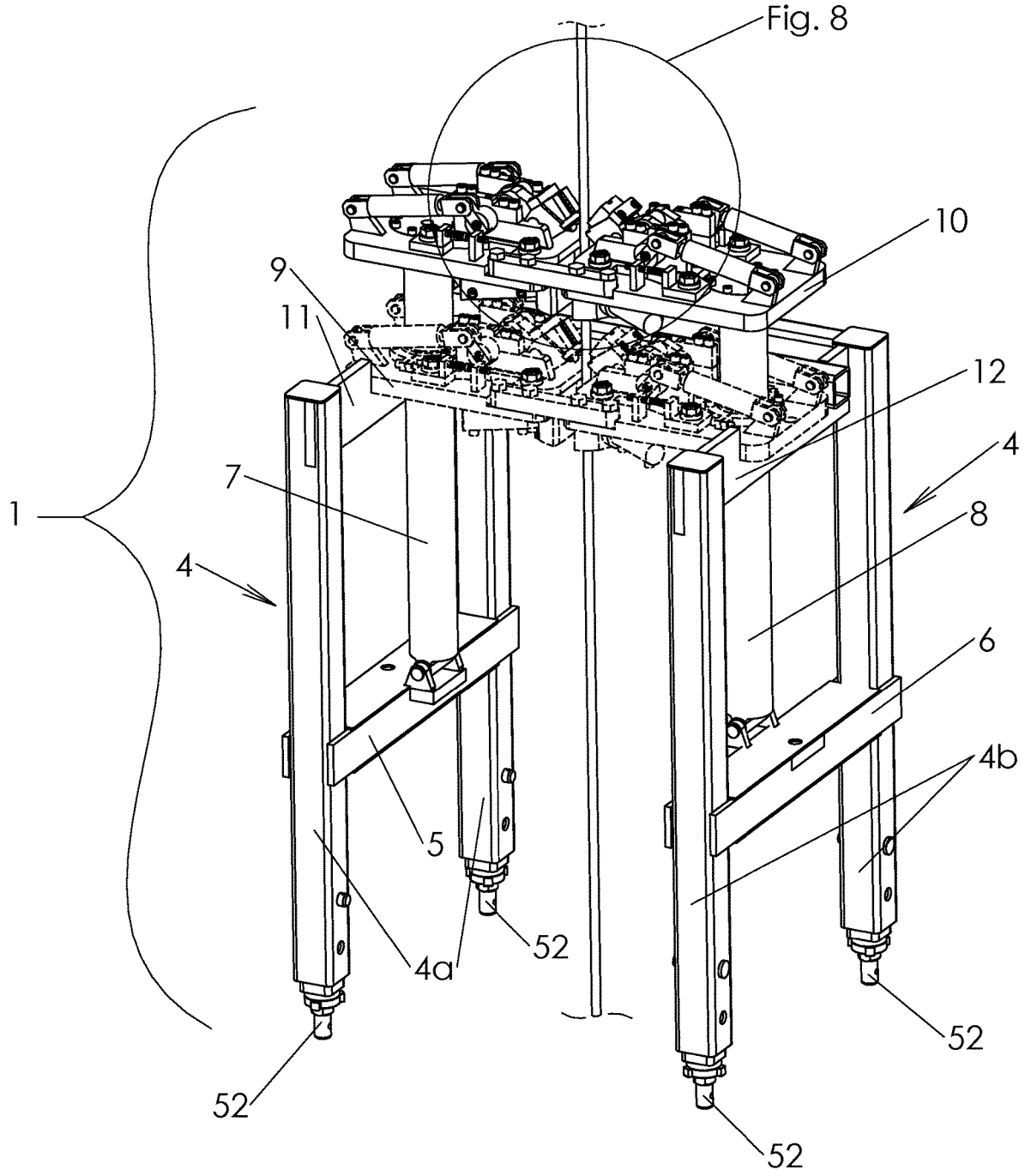
FIG. 4 is a perspective view of the present invention shown situated around the polished rod.

FIG. 4 is a perspective view of the present invention shown situated around the polished rod. In this figure, the rod jack apparatus has been placed over the wellhead, and the polished rod has been inserted into the center of the rod jack apparatus (in the manner described below in connection with FIG. 8), but the rod jack apparatus is in an unclamped position. As shown in this figure, the present invention comprises four vertical legs 4, situated to form a rectangular framework. A first lower bracket S is situated horizontally between and connected to the two left legs 4*a*, and a second lower bracket 6 is situated horizontally between and connected to the two right legs 4*b*. A first hydraulic cylinder 7 extends upwardly from the first lower bracket S, and a second hydraulic cylinder 8 extends upwardly from the second lower bracket 6.

The present invention further comprises a first horizontal plate 9 that is stationary, and a second horizontal plate 10 that is movable in a vertical direction. The top ends of the first and second hydraulic cylinders 7, 8 are connected to the underside of the second horizontal plate 10 and, therefore, move the second horizontal plate 10 up and down as the first and second hydraulic cylinders extend and retract. A first upper bracket 11 is situated horizontally between and connected to the two left legs 4*a* at the upper ends of the two left legs, and a second upper bracket 12 is situated horizontally between and connected to the two right legs 4*b* at the upper ends of the two right legs. The first and second lower brackets 5,6 are preferably situated midway down the legs 4*a*, 4*b*, depending upon the length of the hydraulic cylinders 7, 8.

Figure 5:
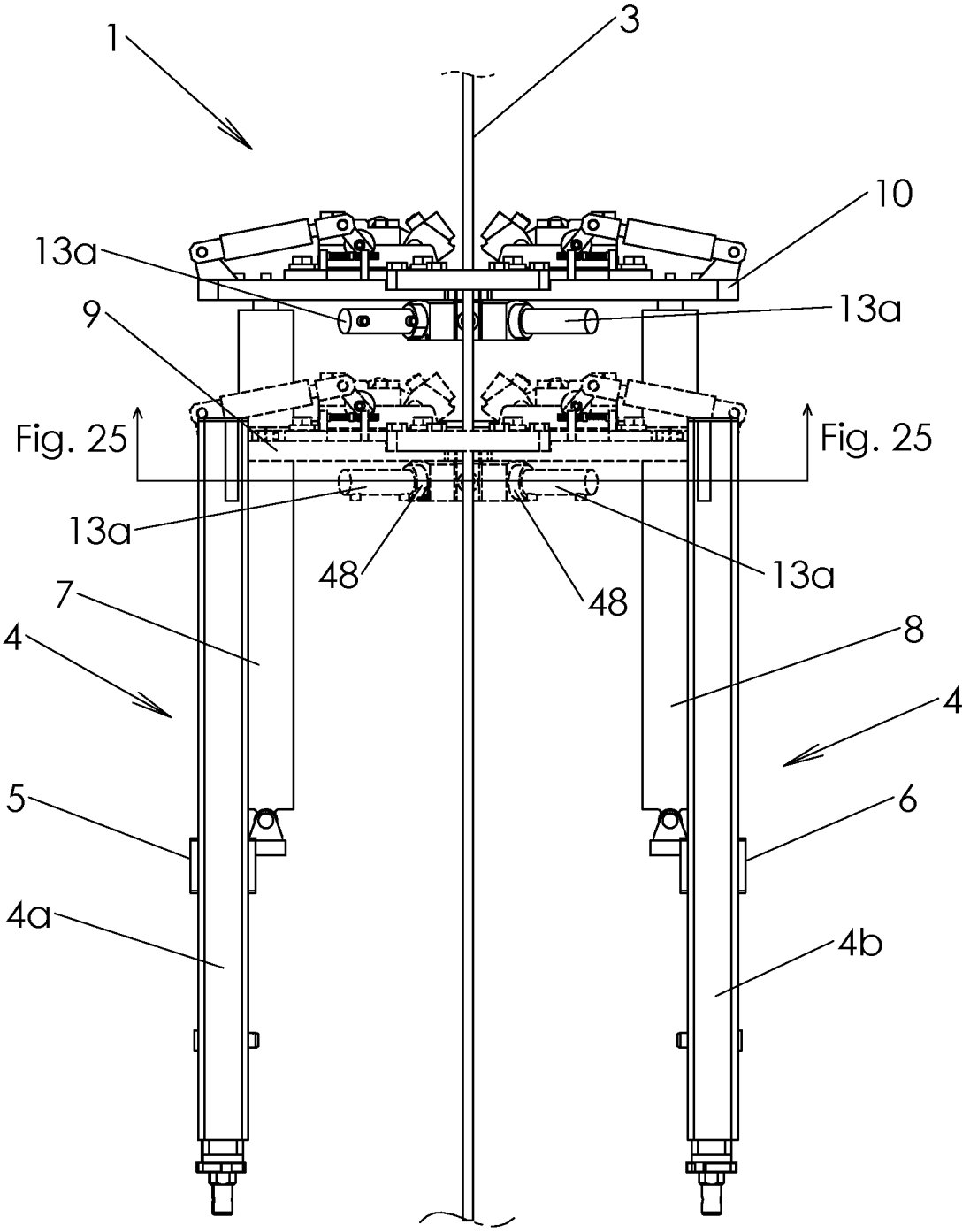
FIG. 5 is a front view of the present invention shown situated around the polished rod.

FIG. 5 is a front view of the present invention shown situated around the polished rod. As in FIG. 4, the rod jack apparatus shown is in an unclamped position, having just been situated over the wellhead. As shown in this figure, situated directly underneath and joined to each of the first and second horizontal plates 9, 10 is a secondary clamping assembly 13 comprised of three hydraulic cylinders 13*a* oriented radially around the polished rod and configured to squeeze the polished rod when the hydraulic cylinders are extended. The secondary clamping assembly 13 is discussed in greater detail in relation to FIGS. 25 and 26.

Figure 32:
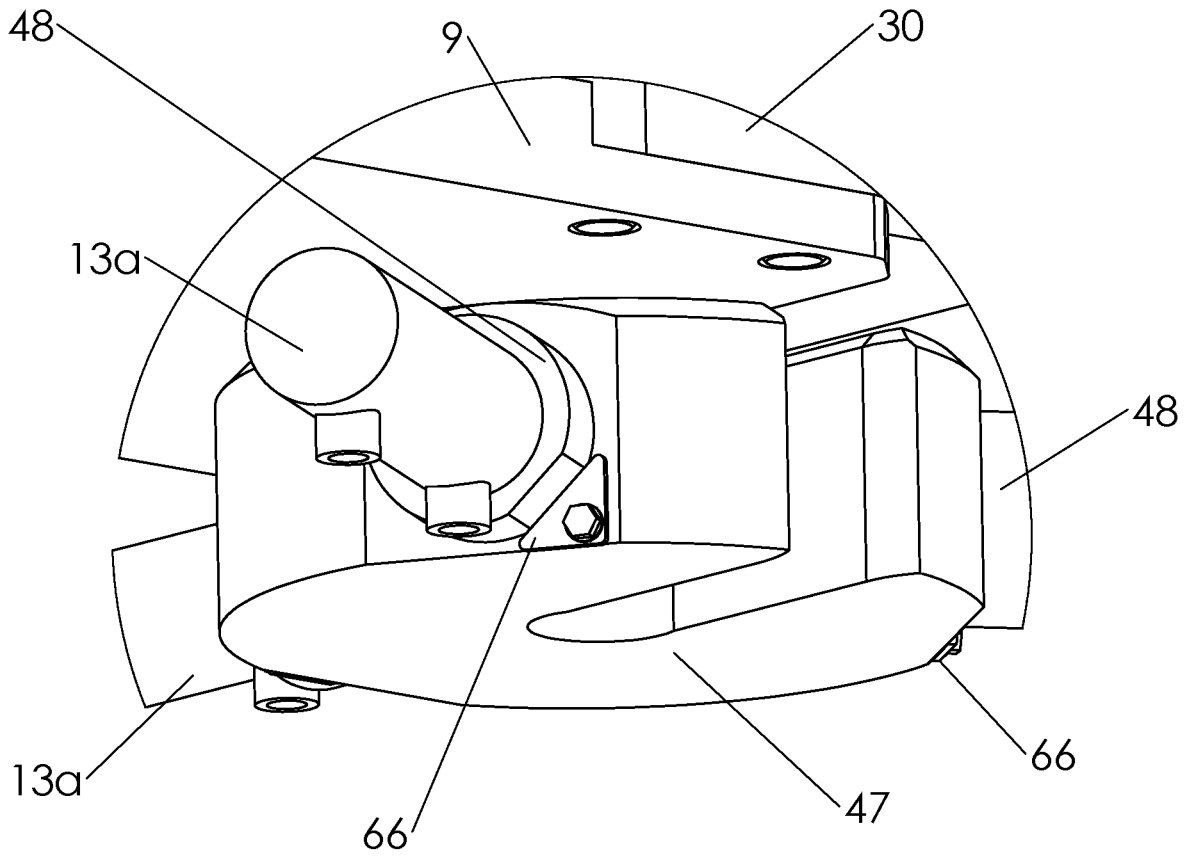
FIG. 32 is a first detail view of the C-plate and C-plate adapter of the present invention.
Figure 33:
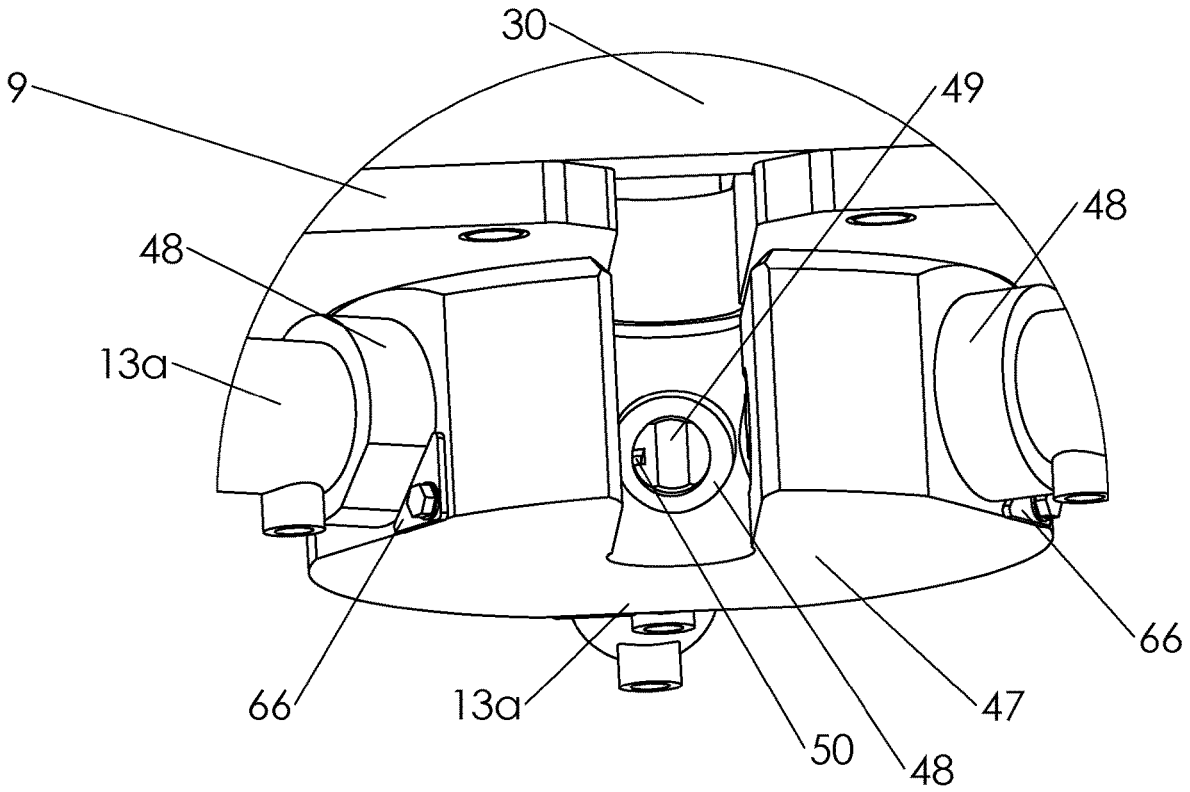
FIG. 33 is a second detail view of the C-plate and C-plate adapter of the present invention.

As shown in FIG. 5, each of the three hydraulic cylinders 13*a* is threadably connected to a C-plate adapter 48. The C-plate adapter 48 is prevented from rotating by virtue of a triangle-shaped member 66, which is bolted to the C-plate 47 and which abuts up against a straight edge on the C-plate adapter 48 (see FIG. 32). A die 49 (see FIGS. 25 and 26)

attached to the distal end of the piston rod of the hydraulic cylinder 13*a* is slidably situated within the C-plate adapter 48 via a pin 50 (see also FIG. 33), which slides along a slot (not shown) in the die. The die 49 preferably comprises a concave surface (not shown) on the distal end of the die, similar to the concave surface of the dies 15, that comes into contact with the polished rod 3 when the secondary clamping assembly 13 is activated and the hydraulic cylinders 13*a* are extended.

Figure 6:
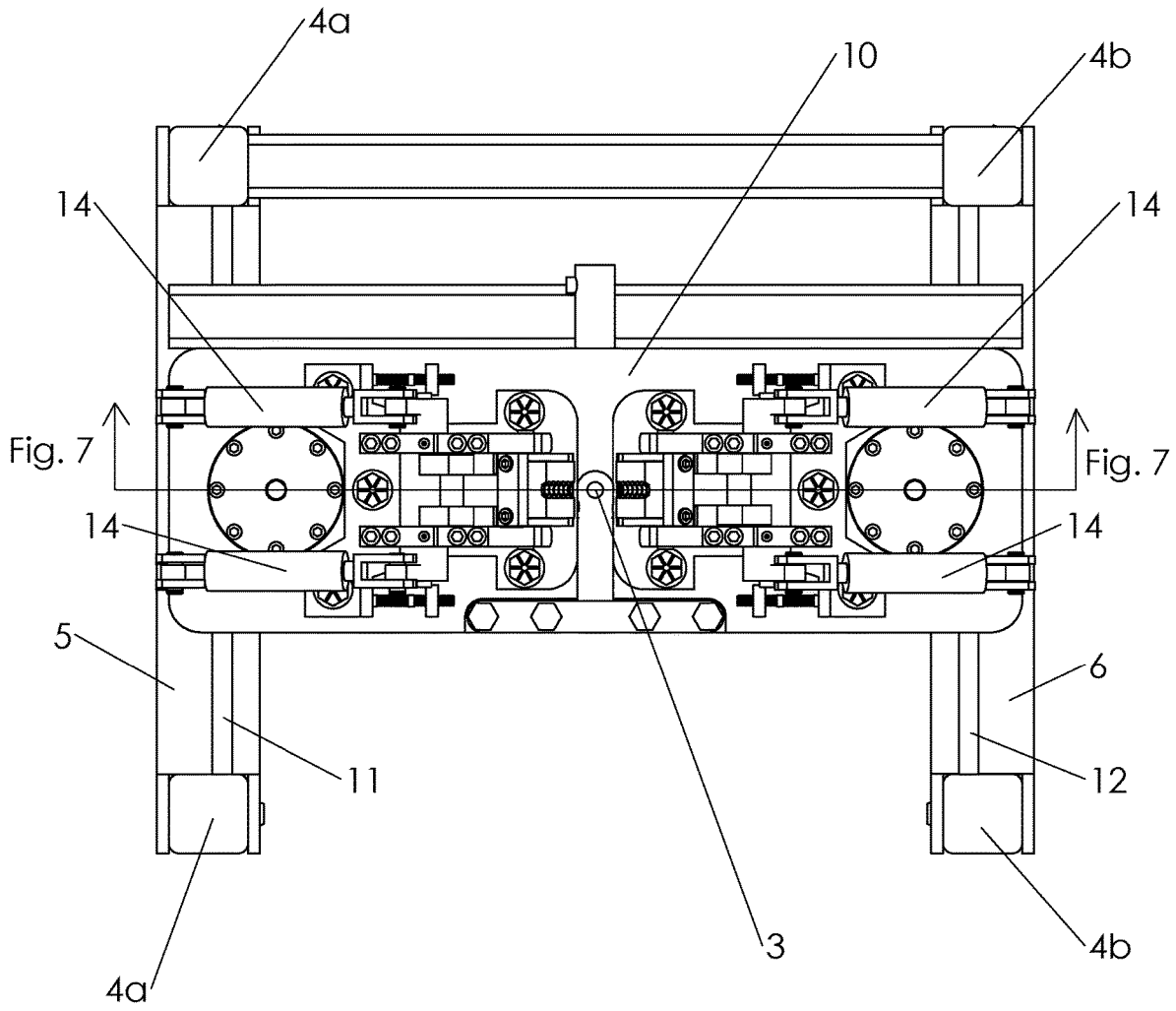
FIG. 6 is a top view of the present invention showing the configuration of the second horizontal plate.

FIG. 6 is a top view of the present invention showing the configuration of the second horizontal plate. The first and second horizontal plates 9,10 are identical except that the first and second hydraulic cylinders 7,8 extend through the first horizontal plate 9, whereas the first and second hydraulic cylinders 7,8 terminate in the second horizontal plate 10 (see FIG. 4). In this figure, the rod jack apparatus is in an unclamped position, as in FIGS. 4 and 5. As shown in this figure, each of the two horizontal plates 9,10 comprises four hydraulic cylinders 14, two of which are oriented in parallel on the right-hand side of the plate, and two of which are oriented in parallel on the left-hand side of the plate. The hydraulic cylinders are aligned so that the two right-hand cylinders face the two left-hand cylinders. The mechanism associated with these hydraulic cylinders 14 is discussed in connection with FIGS. 8,11 and 14 below.

Figure 7:
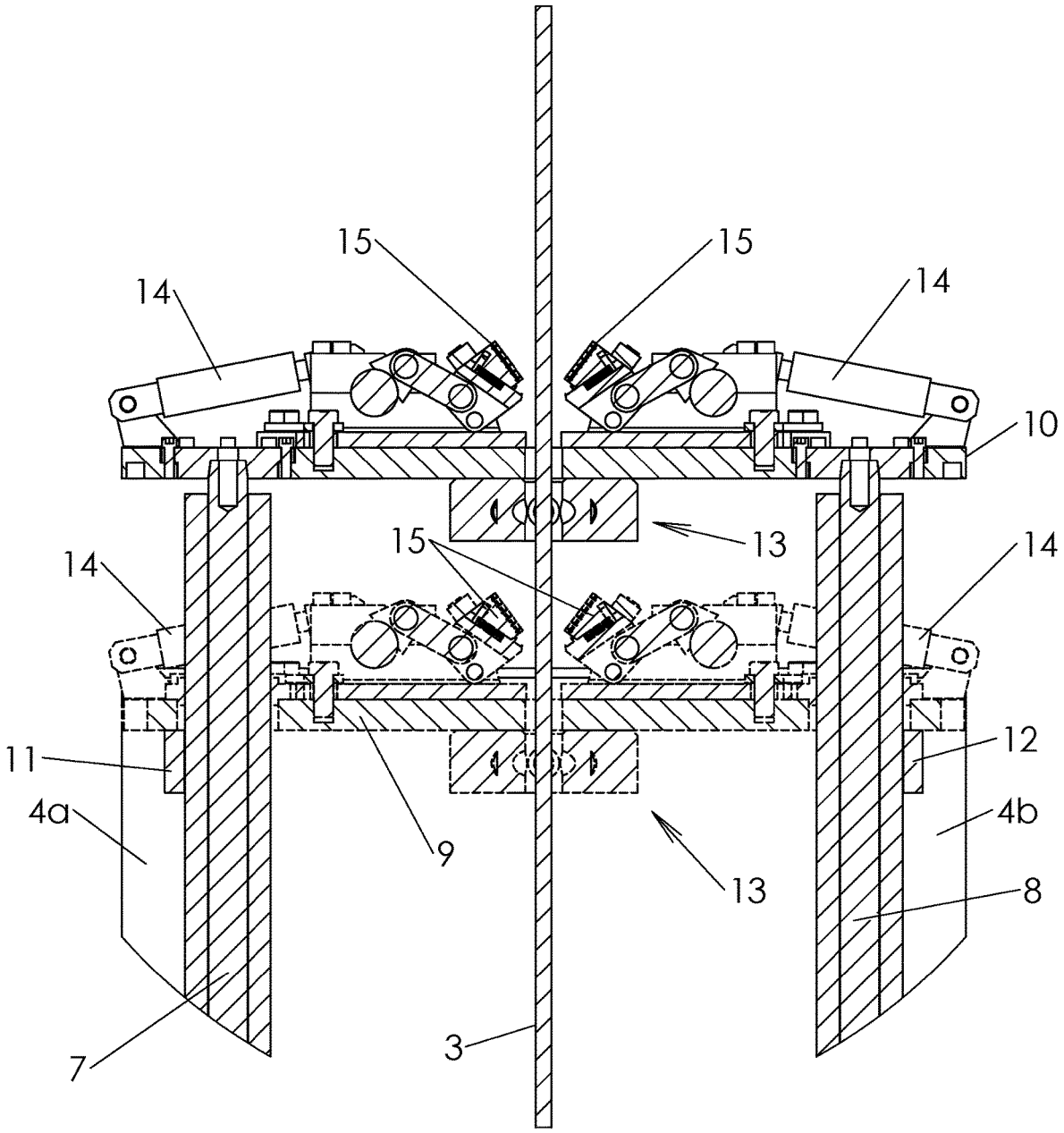
FIG. 7 is a section view of the top end of the present invention taken at the line shown in FIG. 6.

FIG. 7 is a section view of the top end of the present invention taken at the line shown in FIG. 6. In this figure, the rod jack apparatus is still in an unclamped position. This figure clearly shows the hydraulic cylinders 7,8 terminating in the second horizontal plate 10 and the polished rod 3 situated centrally within the first and second horizontal plates 9,10. It also shows the secondary clamping assemblies 13 situated directly underneath each of the first and second horizontal plates 9,10 and configured to squeeze the polished rod 3 when the hydraulic cylinders 13*a* are extended. This figure also shows the dies 15 that form part of the primary clamping assembly 16 and that are indirectly coupled to the hydraulic cylinders 14 on the first and second horizontal plates 9, 10. The primary clamping assembly 16 is discussed in greater detail in connection with FIGS. 8, 11 and 14 below.

Figure 8:
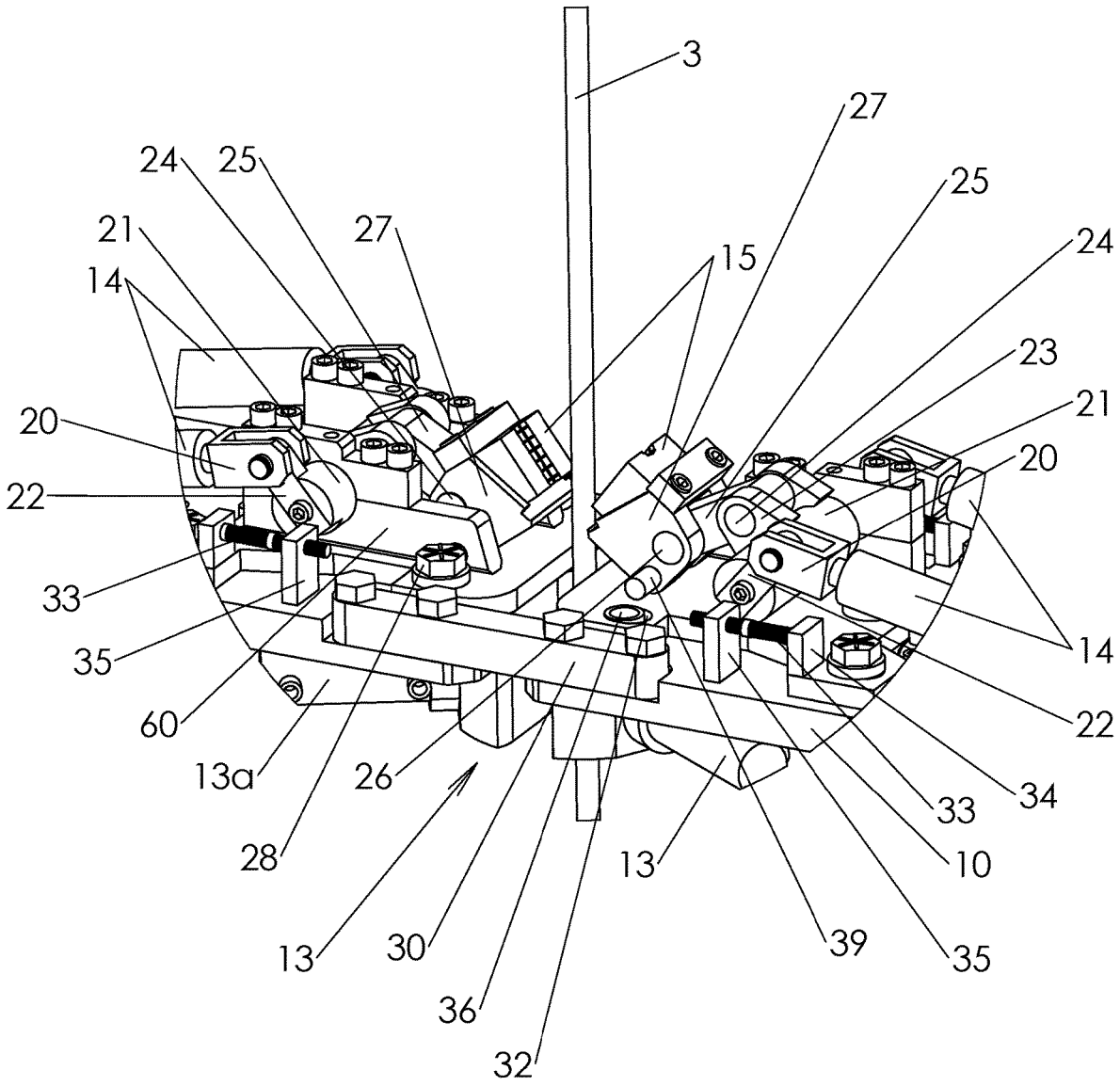
FIG. 8 is a detail view of the primary clamping assembly of the present invention shown with the primary clamping assembly in an open position.

FIG. 8 is a detail view of the primary clamping assembly of the present invention shown with the primary clamping assembly in an open position. (Note that certain parts have been omitted from the right-hand side of this figure from clarity.) As shown in this figure, each hydraulic cylinder 14 is connected to a first bracket 20, which in turn is rotatably connected to a main shaft 21 via a connecting bracket 22. As the hydraulic cylinder 14 is extended, the connecting bracket 22, which is supported by a protrusion 21*a* on the main shaft, causes the main shaft 21 to rotate toward the center of the horizontal plate 9,10. The main shaft comprises two parallel and arcuate protrusions 23 (not coaxially aligned with the protrusion 21*a*) that are configured to receive a second shaft 24 about which rotates a connecting member 25. The two parallel and arcuate protrusions 23 are situated on the main shaft 21 at approximately a 45-degree angle relative to the protrusion 21*a*; they are also situated forward (toward the center of the horizontal plate 9,10) relative to the protrusion 21*a*. One end of the connecting member 25 rotates about the second shaft 24, and the other end of the connecting member 25 rotates about a third shaft 26. Each die 15 resides in a housing 27. The third shaft 26 is rotatably connected to the rear portion of the die housing 27, as shown. Pins 39 on either side of the die housing 27 are inserted into support brackets 60, which extend vertically from the platform 19. The platform 19 is secured to the horizontal plate 9, 10 with bolts 28.

Figure 10:
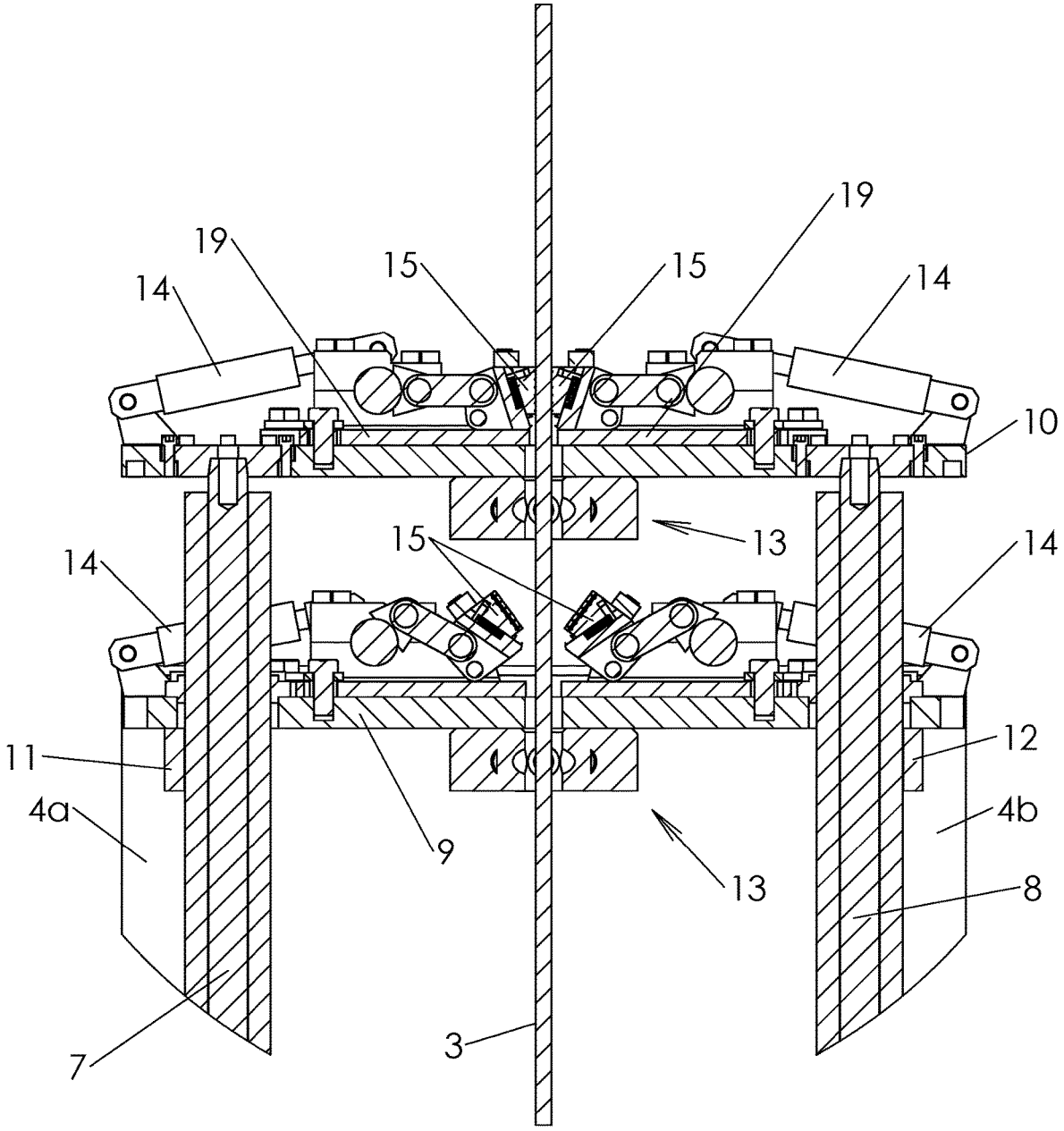
FIG. 10 is a section view of the present invention as shown in FIG. 9 taken from the same perspective as in FIG. 7.
Figure 11:
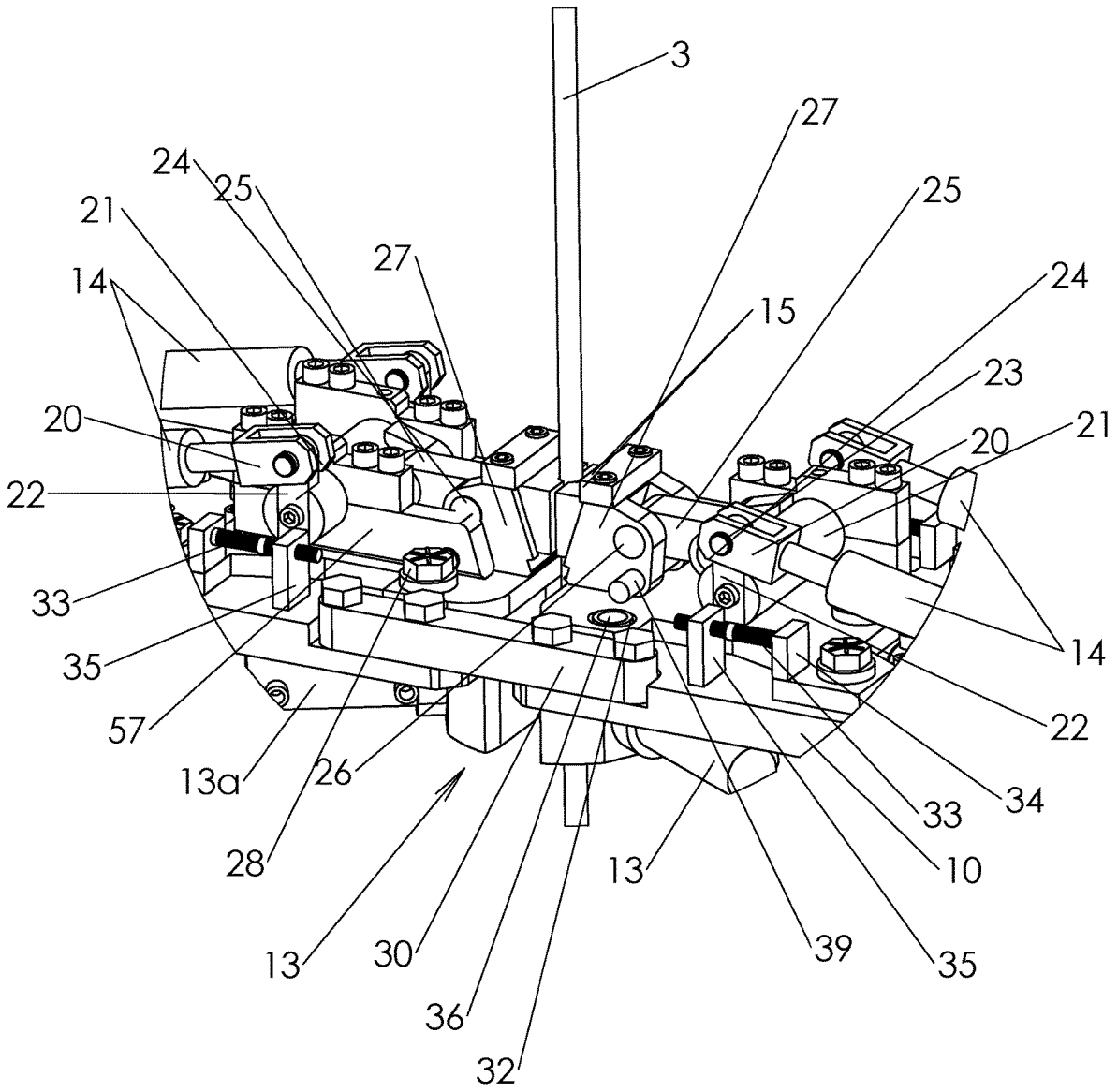
FIG. 11 is a detail view of the primary clamping assembly of the present invention shown with the primary clamping assembly in a first closed position.

With this configuration, when the hydraulic cylinders 14 are extended, through the various fixed and rotatable connections described above, the dies 15 are rocked or rotated into the position shown in FIG. 11, in which the front surface of the die 15 (see FIG. 27) is in contact with the polished rod 3. The dies 15 do not move in either direction (left to right or front to back) relative to the platform 19. Note in FIG. 11 the gap 17 (between the bottom of the die 15 and the top surface of the platform 19) that is also shown in FIG. 10.

FIG. 8 also illustrates how the polished rod 3 is inserted into the rod jack apparatus when the invention is situated over the wellhead. The horizontal plate 9,10 comprises a front recess 29 that is configured to receive a bracket 30, which is then bolted to the horizontal plate 9,10, as shown. This bracket 30 is removed when the present invention is situated over the wellhead, and the polished rod 3 is slid into the central channel 31 (see FIG. 6) in the horizontal plate 9,10. The central channel 31 extends from the front to the center of the horizontal plate 9,20 so that the polished rod 3 is situated in the center of the rod jack apparatus when fully inserted into the central channel 31. The platform 19 is situated directly on top of the horizontal plate 9,10, and the primary clamping assembly 16 is situated on top of the platform 19.

In FIG. 8, one of the bolts 28 that secures the die housing 27 to the platform 19 has been omitted to illustrate the movement of the platform 19 on the horizontal plate 9, 10. Each bolt 28 extends through an oval-shaped hole 32 in the platform 19; a circular hole 36 in the underlying horizontal plate 9,10 directly underlies the oval-shaped hole 32 in the platform 19. A spring 33 is situated between a first vertical bracket 34, which is fixedly attached to the platform 19, and a second vertical bracket 35, which is fixedly attached to the horizontal plate 9,10 underlying the platform 19. When the hydraulic cylinder 14 is retracted, as shown in FIG. 8, the spring 33 biases die platform in a slightly outward position (away from the polished rod 3) relative to the horizontal plate 9, 10. This is illustrated by the position of the circular hole 36 relative to the oval-shaped hole 32. When the hydraulic cylinder 14 is extended, as shown in FIG. 11, the platform 19 is moved slightly forward (closer to the polished rod 3), the spring 33 is compressed, and the position of the circular hole 36 relative to the oval-shaped hole 32 changes slightly so that the circular hole 36 is now situated in the center of the oval-shaped hole 32 rather than at the front end of it (as shown in FIG. 8). In this manner, the platform is movable relative to the horizontal plate 9,10.

The purpose of this movement of the platform 19 relative to the horizontal plate 9, 10 is to ensure that when the dies 15 are tilted forward by the hydraulic cylinders 14 and the intervening linkages, the entire surface of the concave section 37 on the front surface of the die 15 (see FIG. 27) comes into contact with the polished rod 3 at the same time; in other words, the idea is to prevent the bottom edge of the die 15 from coming into contact with the polished rod 3 before the rest of the concave surface 37 is vertically aligned with it. When the primary clamping assembly is released, the spring 33 moves the platform 19 back again relative to the horizontal plate 9,10, which allows the dies to disengage from the polished rod 3 before they are tilted backward again.

Figure 9:
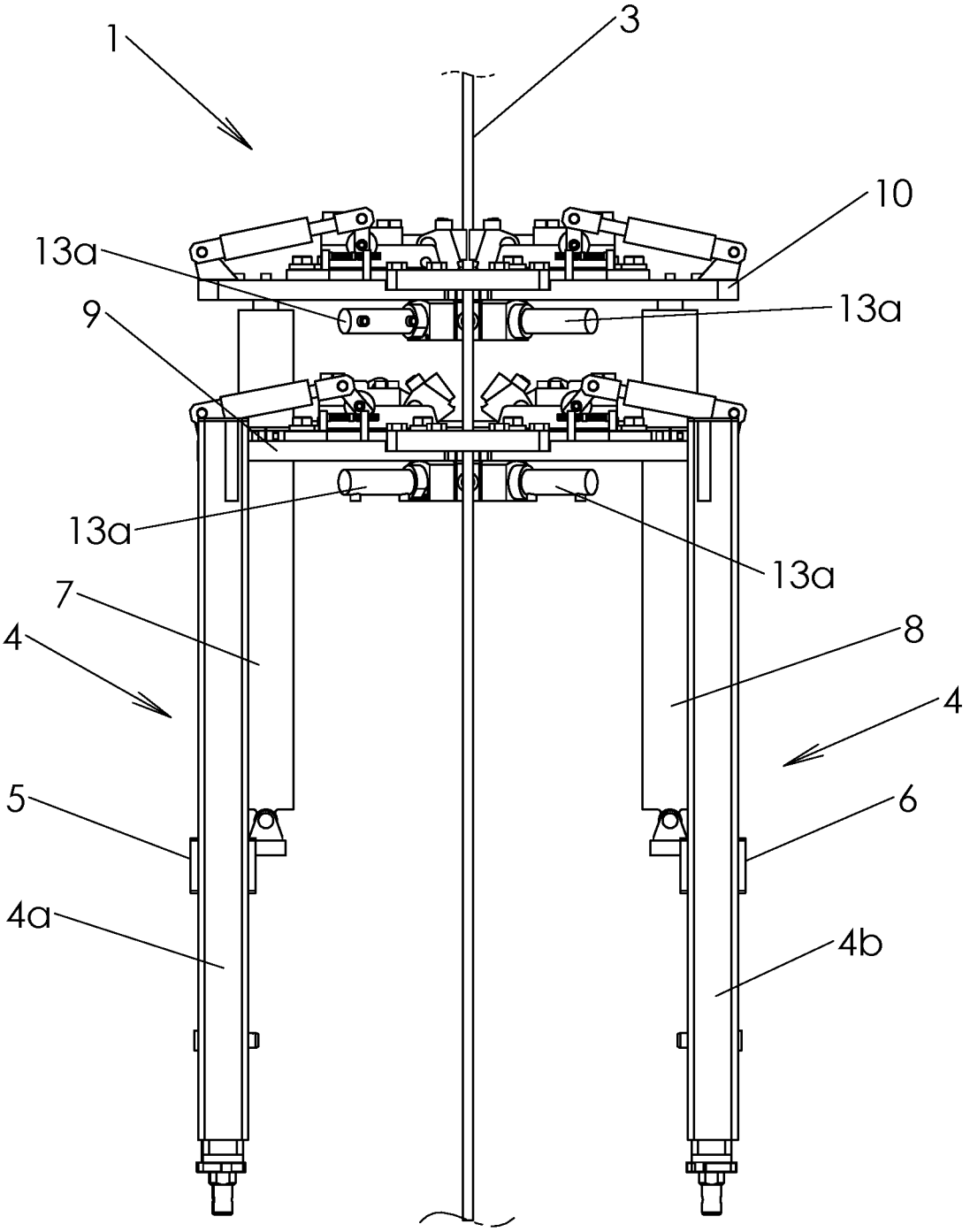
FIG. 9 is a front view of the present invention shown with the primary clamping assembly of the second horizontal plate in a first closed position.

FIG. 9 is a front view of the present invention shown with the primary clamping assembly of the second horizontal plate in a first closed position. (In FIGS. 4-7, the primary clamping assembly 16 on both the first (bottom) and second (top) horizontal plates 9,10 is in an open position.) In this figure, the dies 15 on the second horizontal plate 10 have been closed around the polished rod 3 by the extension of the hydraulic cylinders 14.

FIG. 10 is a section view of the present invention as shown in FIG. 9 taken from the same perspective as in FIG. 7. In this figure, the dies 15 (there are four of them) on the second (top) horizontal plate 10 are clamped around the polished rod 3. The dies 15 on the first horizontal plate 9 are still in a retracted (or open) position. The hydraulic cylinders 7,8 are still in a fully retracted position, and the second horizontal plate 10 is still in the same position relative to the first horizontal plate 9 as shown in the preceding figures.

FIG. 11 is a detail view of the primary clamping assembly of the present invention shown with the primary clamping assembly in a first closed position. The first stage of clamping has been described above relative to FIG. 8. In this figure, the spring 33 is compressed, as noted above.

Figure 12:
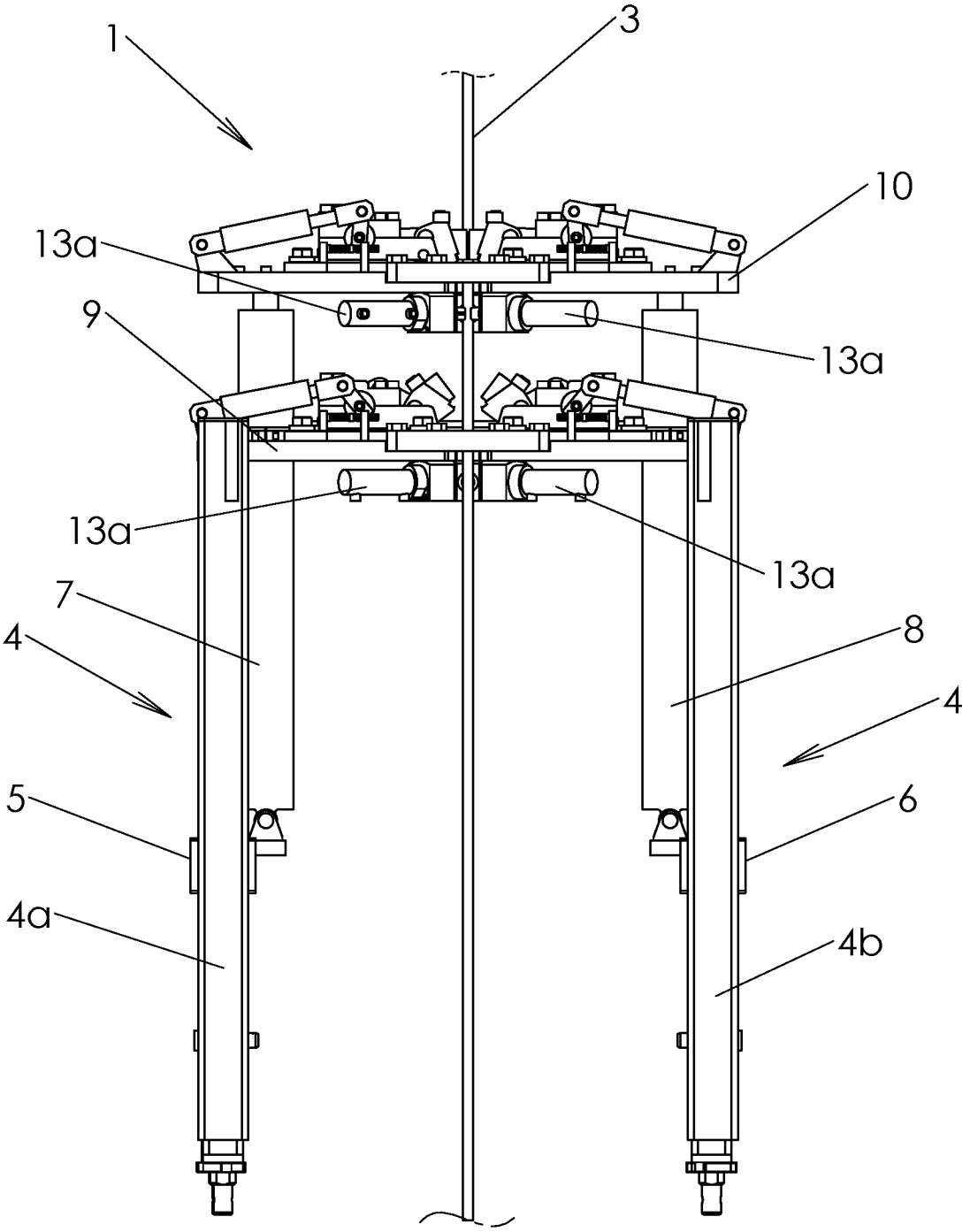
FIG. 12 is a front view of the present invention shown with the primary clamping assembly of the second horizontal plate in a second closed position.

FIG. 12 is a front view of the present invention shown with the primary clamping assembly of the second horizontal plate in a second closed position. In this figure, the hydraulic cylinders 7, 8 have been extended just enough to lift the second horizontal plate 10 upward a sufficient distance to lock the dies 15 on the second horizontal plate 10 in place (this locking mechanism is discussed more fully below in connection with FIG. 14).

Figure 13:
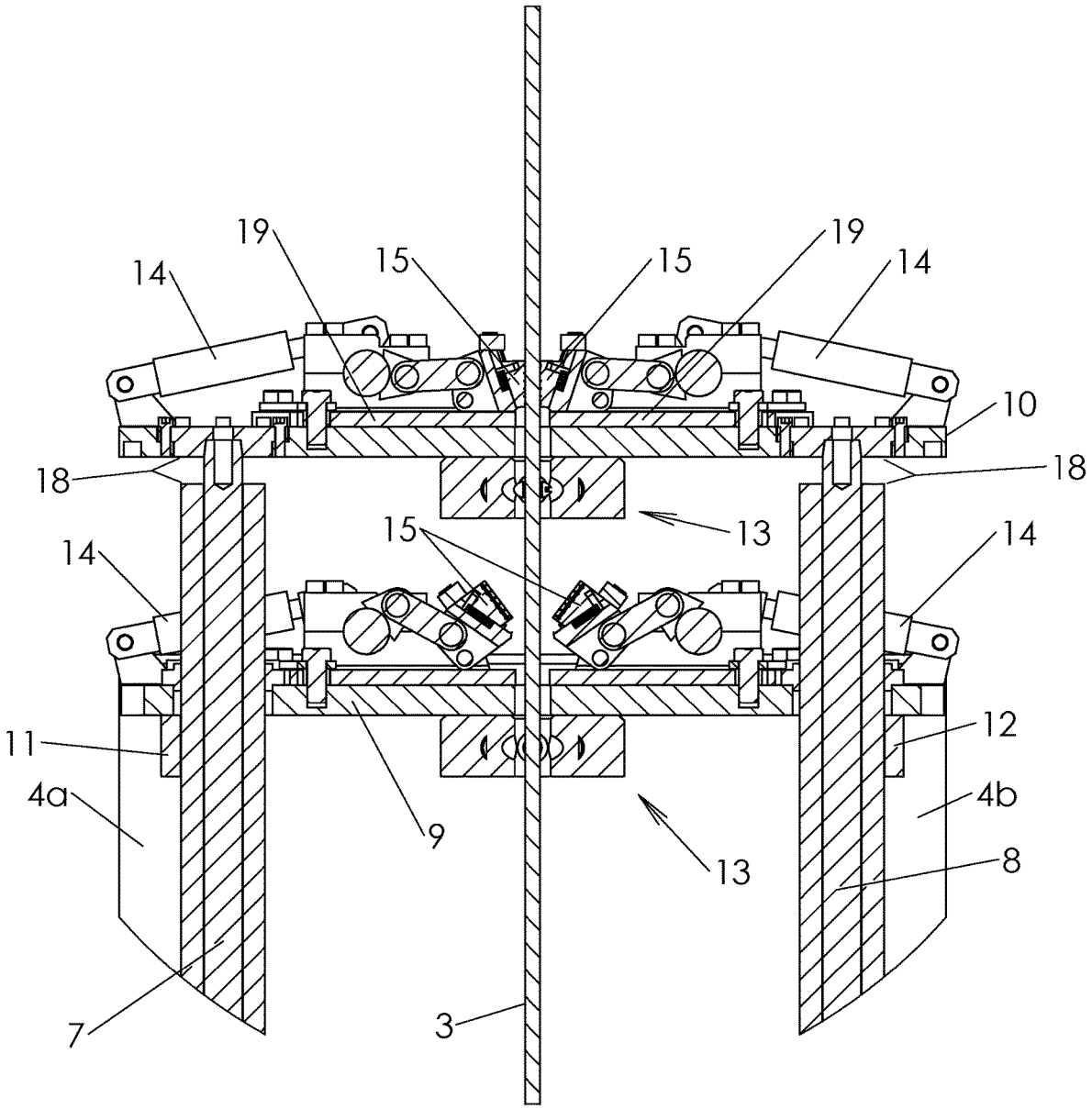
FIG. 13 is a section view of the present invention as shown in FIG. 12 taken from the same perspective as FIG. 7.

FIG. 13 is a section view of the present invention as shown in FIG. 12 taken from the same perspective as FIG. 7. Note that the gap 17 that is shown in FIG. 10 directly underneath the dies 15 has been eliminated in FIG. 9. Note also that the gap 18 between the top end of the casing of the hydraulic cylinders 7, 8 and the bottom surface of the second horizontal plate 10 has been increased slightly in FIG. 13 as compared to FIG. 10. Although not discernable in FIG. 12 or 13, the hydraulic cylinders 13*a* of the secondary clamping assembly 13 are also extended at this time; therefore, the second horizontal plate 10 begins to move upward at the same time that the hydraulic cylinders 13*a* are extended to clamp around the polished rod 3. In this manner, both the primary and the secondary clamping assemblies 16,13 are activated at the same time.

The primary clamping assembly has two stages—the initial positioning of the dies around the polished rod, as shown in FIGS. 9 and 10, and then the locking of the dies into place as the second horizontal plate 10 begins to move upward, as shown in FIGS. 12 and 13. As used herein, the term "first closed position" refers to the first stage of clamping of the primary clamping assembly, and the term "second closed position" refers to the second stage of clamping of the primary clamping assembly. The secondary clamping assembly has only one stage, which is the extension of the hydraulic cylinders 13*a* around the polished rod. Referring to FIG. 13, at this juncture in the operation of the present invention, the polished rod is now securely held by the second horizontal plate 10 by virtue of both the primary 16 and secondary 13 clamping assemblies. The primary and secondary clamping assemblies of the first horizontal plate 9 at this stage are still open (inactivated).

Figure 14:
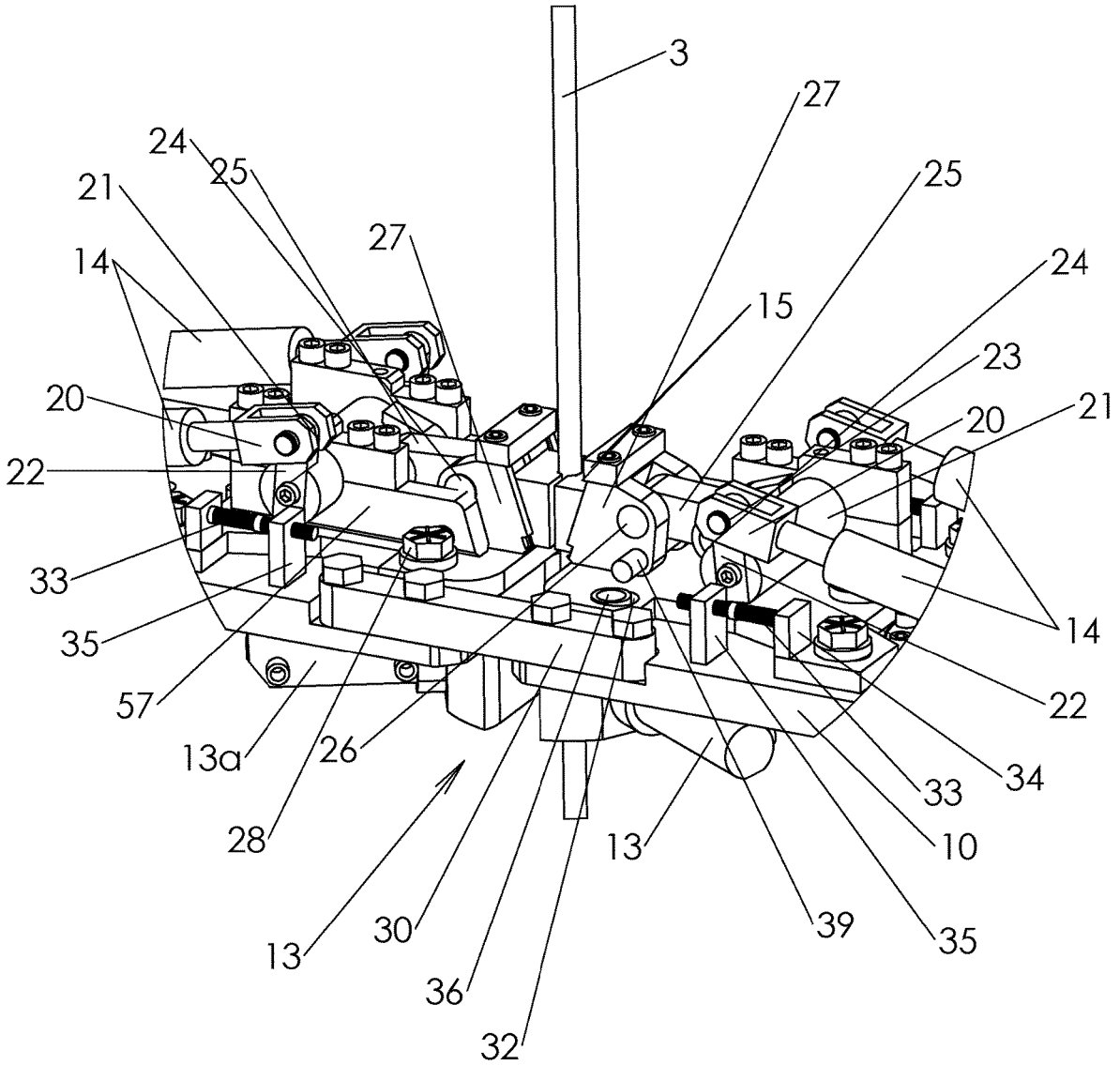
FIG. 14 is a detail view of the primary clamping assembly of the present invention shown with the primary clamping assembly in a second closed position.

FIG. 14 is a detail view of the primary clamping assembly of the present invention shown with the primary clamping assembly in a second closed position. During this second stage of clamping, the hydraulic cylinders 7, 8 begin to move the second horizontal plate 10 upward, which causes the polished rod 3 to move downward relative to the dies 15 until the gap 17 (shown in FIGS. 10 and 11) is eliminated. Once this happens, the primary clamping mechanism 16 is in a fully locked position, and the polished rod 3 will now move upward with the second horizontal plate 10. As noted above, the secondary clamping mechanism 13 is also activated at this time. In this figure, the spring 33 is decompressed.

Both the primary and the secondary clamping mechanisms described above work the same for die first and second horizontal plates 9,10. The only difference in the clamping process between the two horizontal plates is that, because the first horizontal plate 9 does not move, the first stage (i.e., first closed position) of the primary clamping assembly 16 on the first horizontal plate 9 is achieved when the second horizontal plate 10 releases from its clamping position, thereby causing the polished rod 3 to move slightly downward (by the force of gravity) within the primary clamping assembly 16 of the first horizontal plate 9 (which is already in the first closed position). This slight downward movement of the polished rod 3 within the primary clamping assembly 16 of the first horizontal plate has the same effect as the second horizontal plate 10 moving upward; that is, it causes the primary clamping assembly 16 on the first horizontal plate 9 to move into the second closed position.

Figure 15:
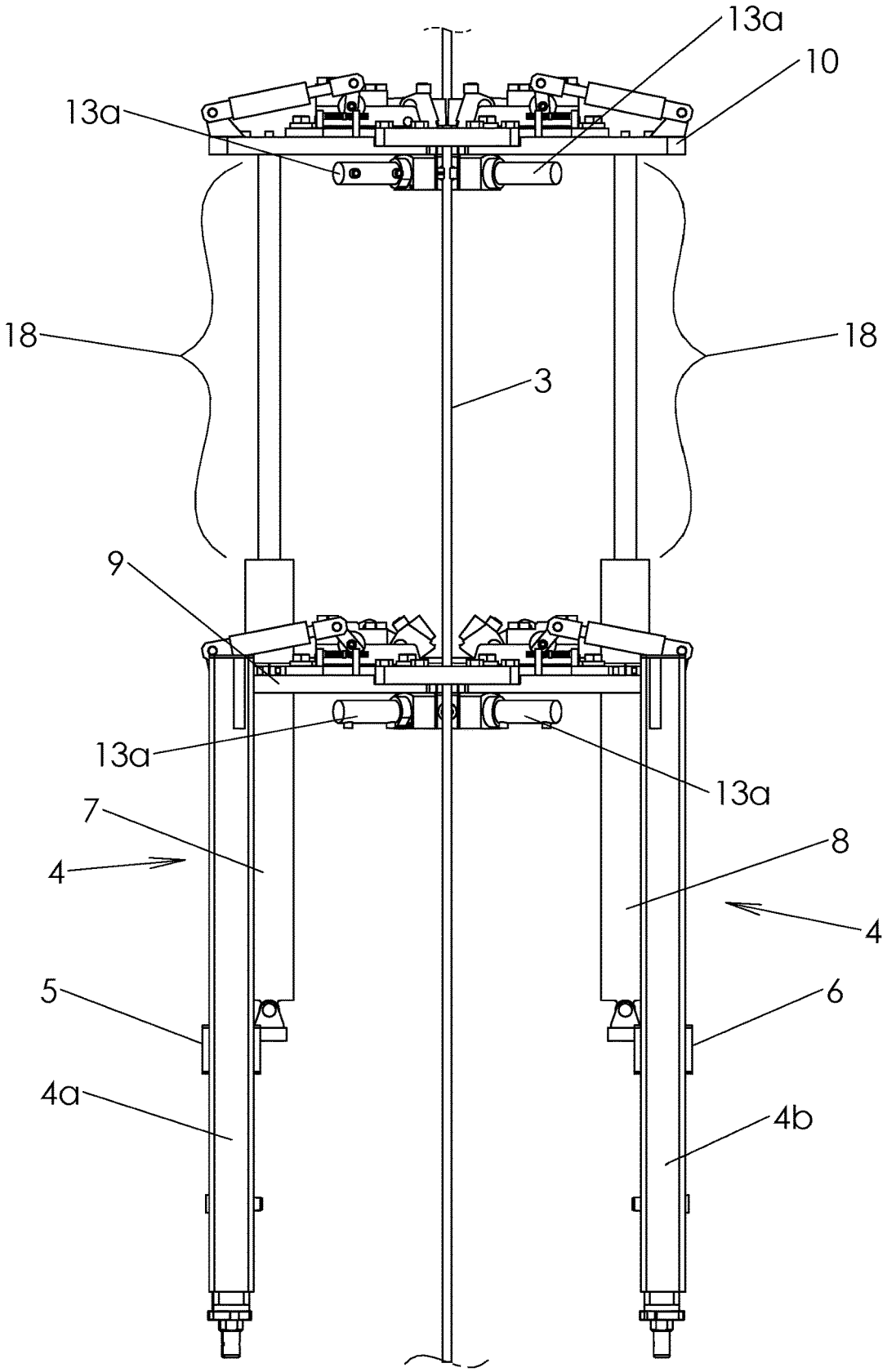
FIG. 15 is a front view of the present invention shown with the second horizontal plate in a fully clamped position and with the first and second hydraulic cylinders fully extended.

FIG. 15 is a front view of the present invention shown with the second horizontal plate in a fully clamped position and with the first and second hydraulic cylinders fully extended. In this position, the gap 18 between the top of the housing of the hydraulic cylinder 7, 8 and the bottom surface of die second horizontal plate 10 is significantly greater than in FIGS. 12 and 13. As the hydraulic cylinders 7, 8 are fully extended, the second horizontal plate 10 moves upward, carrying the polished rod 3 with it by virtue of the fact that the primary and secondary clamping assemblies are both activated.

Figure 16:
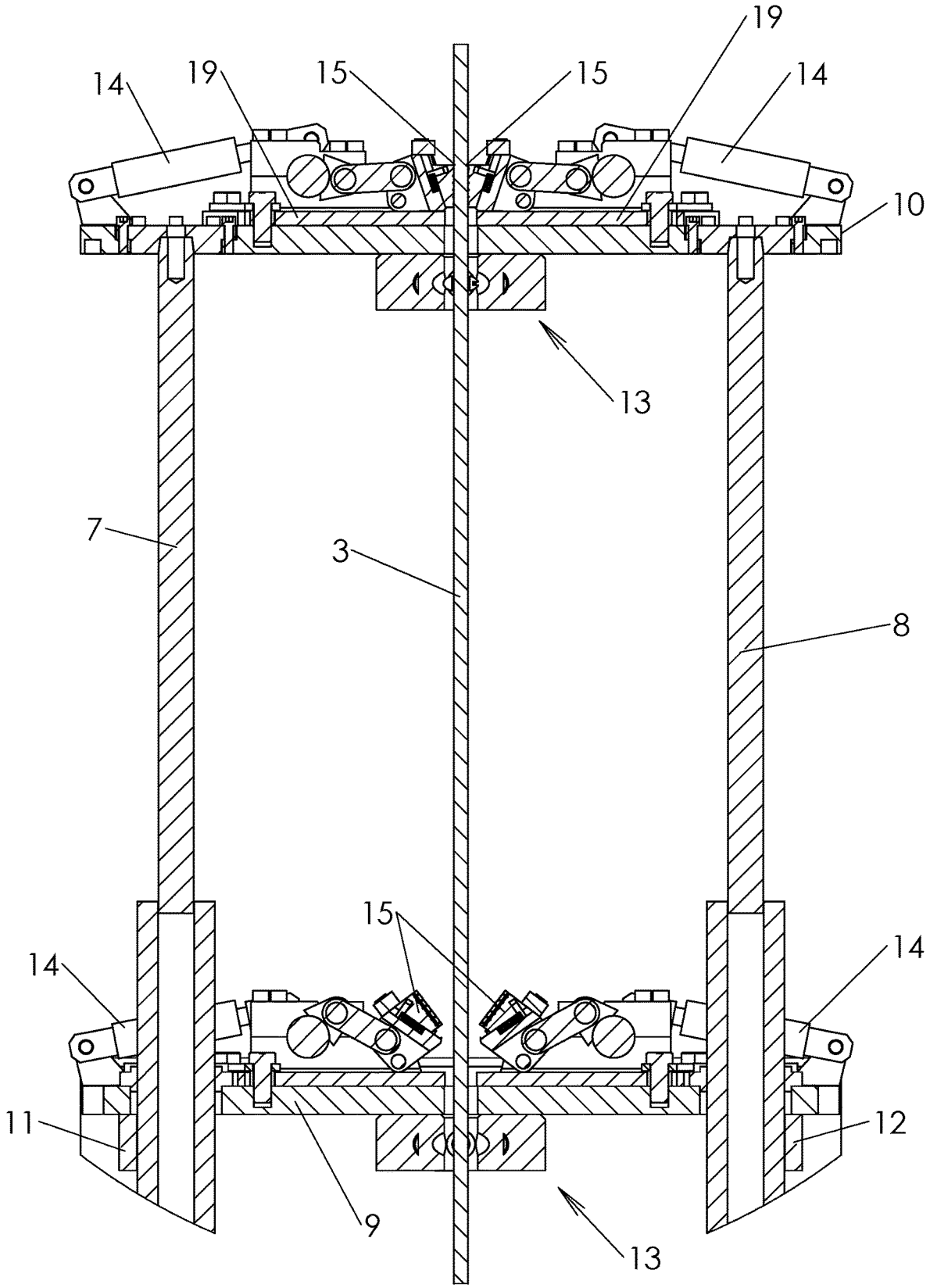
FIG. 16 is a section view of the present invention as shown in FIG. 15 taken from the same perspective as FIG. 7.

FIG. 16 is a section view of the present invention as shown in FIG. 15 taken from the same perspective as FIG. 7. As shown in this figure, the primary clamping mechanism 16 on the first horizontal plate 9 has not yet been activated; the dies 15 are not in contact with the polished rod 3.

Figure 17:
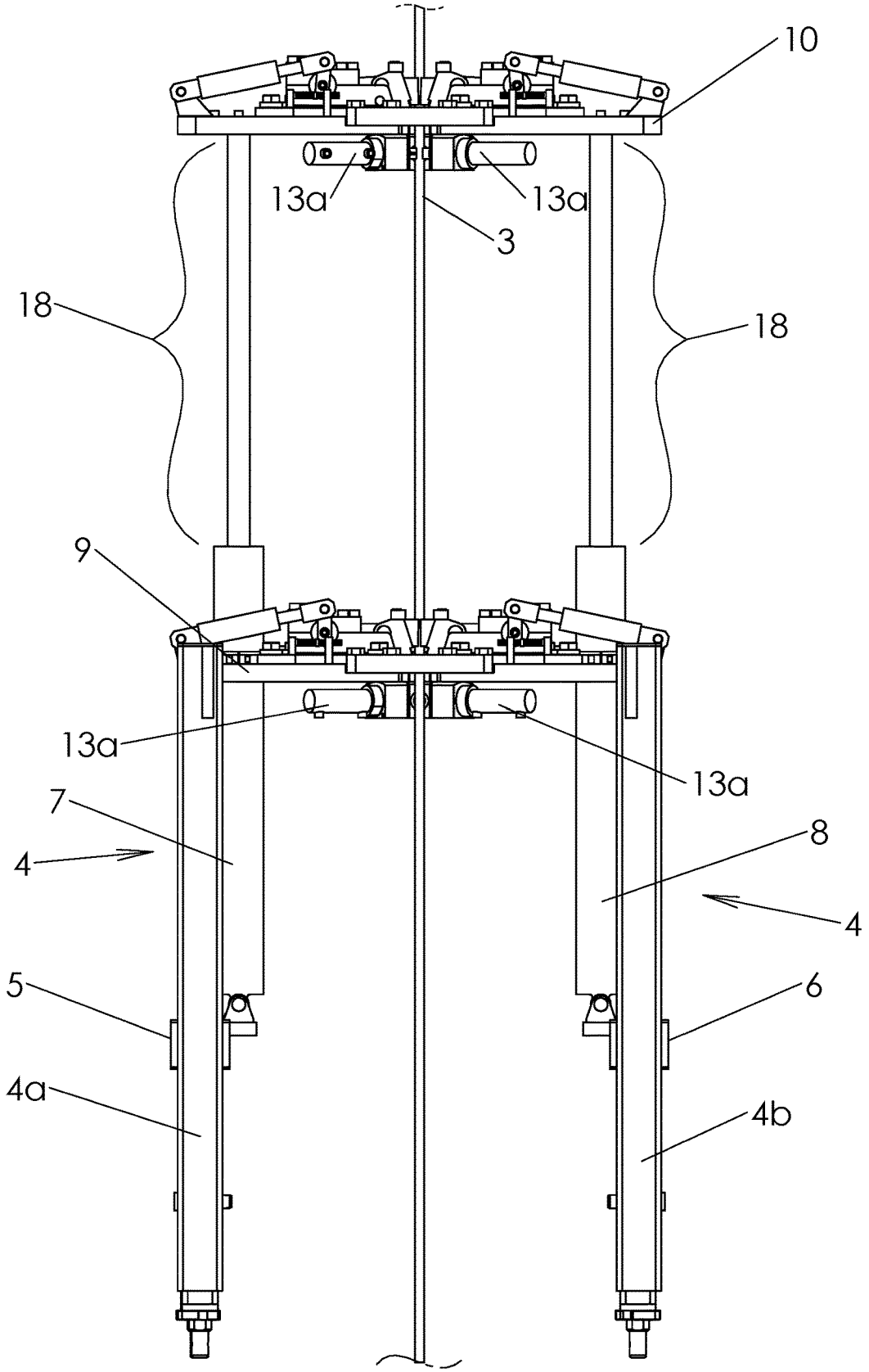
FIG. 17 is a front view of the present invention shown with the second horizontal plate in a fully clamped position, the first and second hydraulic cylinders fully extended, and the primary clamping assembly of the first horizontal plate in a first closed position.

FIG. 17 is a front view of the present invention shown with the second horizontal plate in a fully clamped position, the first and second hydraulic cylinders fully extended, and the primary clamping assembly of the first horizontal plate in a first closed position. At this stage of operation, the second horizontal plate 10 is still fully clamped around the polished rod 3, and the clamping process of the first horizontal plate 9 has begun. The primary clamping assembly 16 on the first horizontal plate 9 is in a first closed position, similar to that shown in FIG. 9 relative to the second horizontal plate 10.

Figure 18:
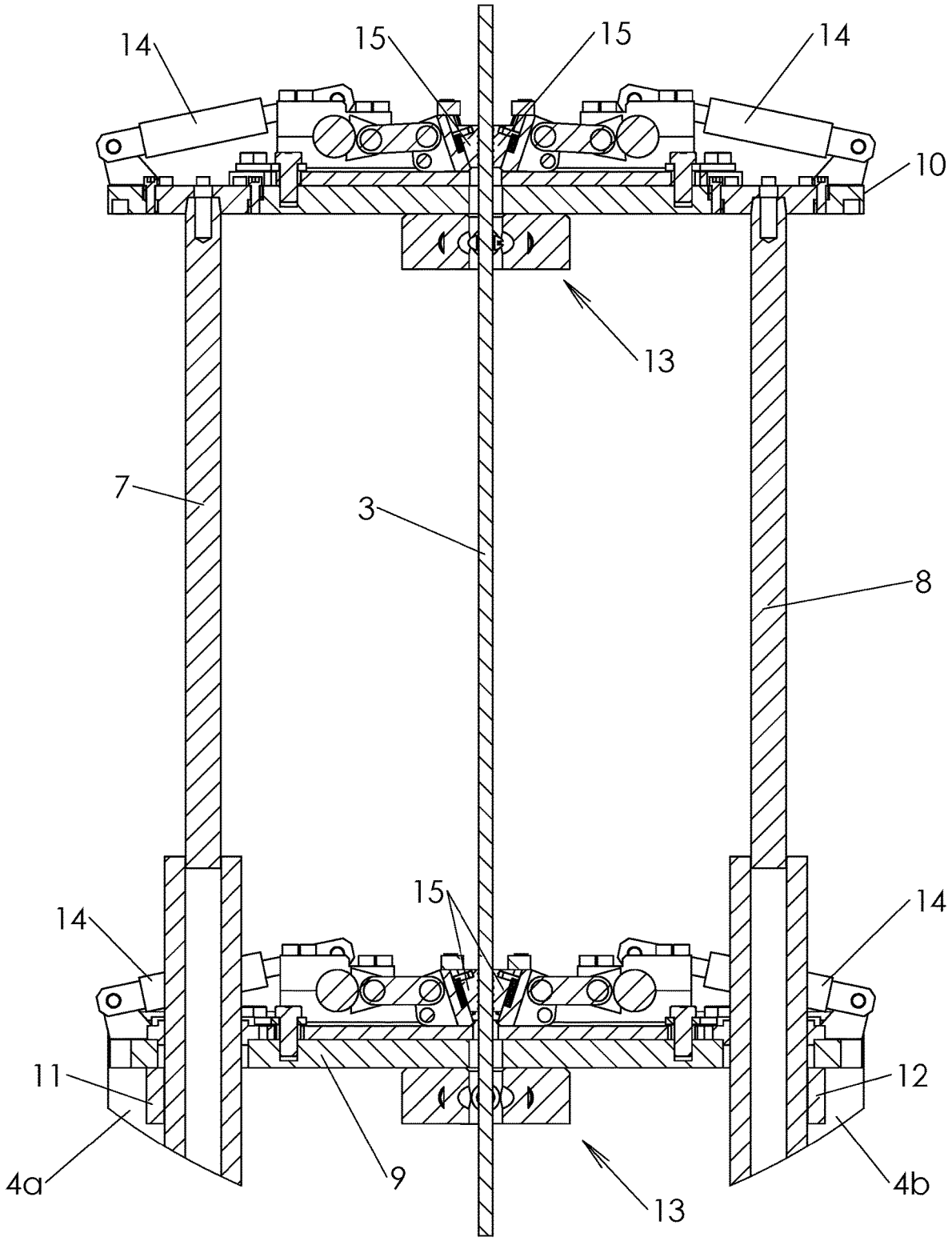
FIG. 18 is a section view of the present invention shown in FIG. 17 taken from the same perspective as FIG. 7.

FIG. 18 is a section view of the present invention shown in FIG. 17 taken from the same perspective as FIG. 7. Although not discernable in this figure, the secondary clamping assembly 13 of the second horizontal plate 10 is activated, but the secondary clamping assembly 13 of the first horizontal plate 9 is not.

Figure 19:
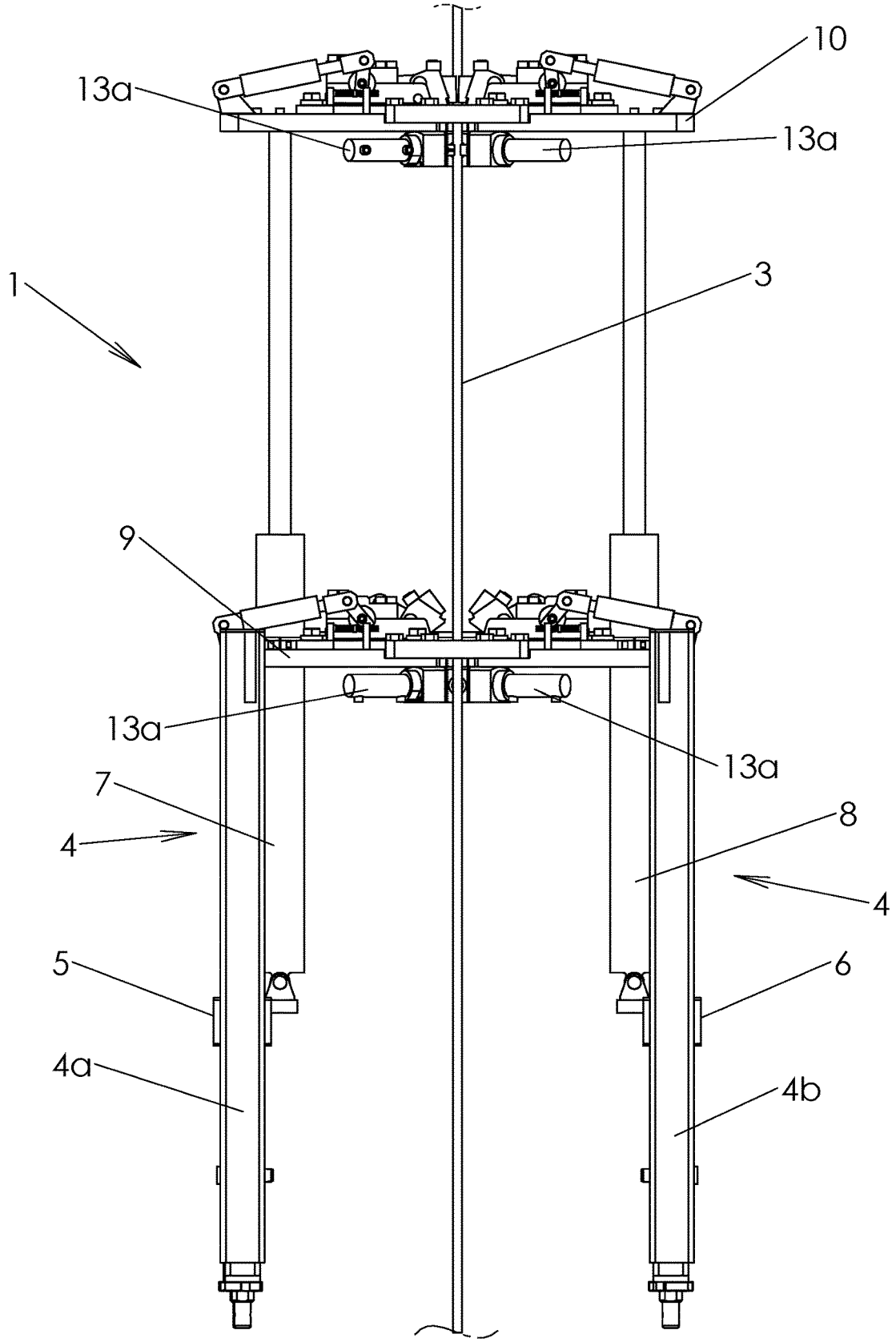
FIG. 19 is a front view of the present invention shown with the second horizontal plate in an unclamped position, the first horizontal plate in a fully clamped position, and the first and second hydraulic cylinders fully extended.

FIG. 19 is a front view of the present invention shown with the second horizontal plate in an unclamped position, the first horizontal plate in a fully clamped position, and the first and second hydraulic cylinders fully extended. At this stage in the operation, the polish rod 2 has now been lifted a certain distance out of the well (the distance represented by the full extension of the hydraulic cylinders 7,8), and the second horizontal plate 10 is unclamped from the polished rod 3; that is, both the primary and the secondary clamping assemblies 16,13 are inactivated. At this point, the primary clamping assembly 16 of the first horizontal plate 9 transitions from a first closed position to a second closed position as the weight of the polished rod 3 pulls the dies 15 downward in to a fully closed position and the gap 17 is eliminated. At the same time, the secondary clamping assembly 13 is activated so that the polished rod 3 is now securely held by the first horizontal plate 9.

Figure 20:
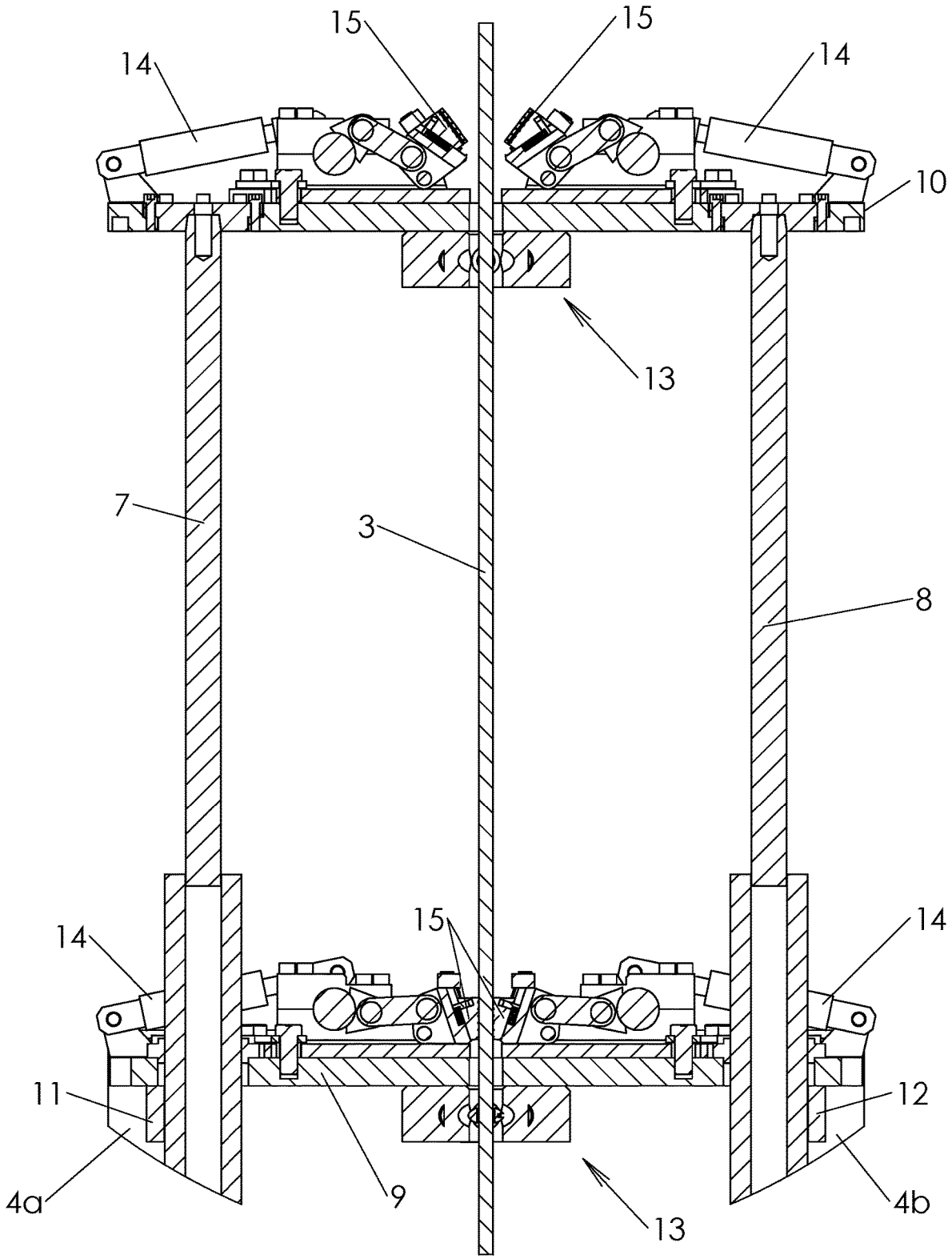
FIG. 20 is a section view of the present invention shown in FIG. 19 taken from the same perspective as FIG. 7.

FIG. 20 is a section view of the present invention shown in FIG. 19 taken from the same perspective as FIG. 7. As shown in this figure, the first and second hydraulic cylinders 7,8 are still fully extended, and the polished rod 3 is now held by the first horizontal plate 9.

Figure 21:
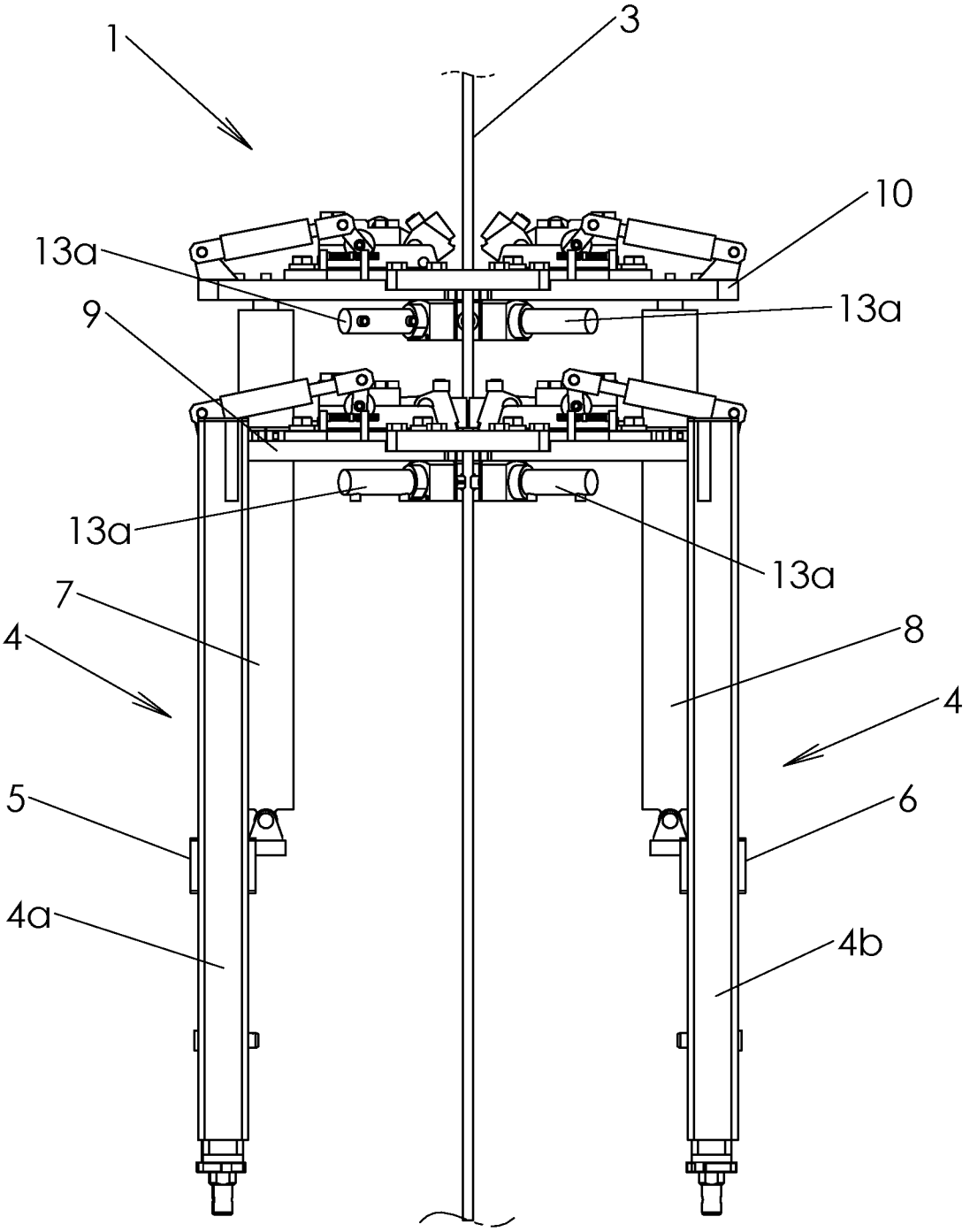
FIG. 21 is a front view of the present invention shown with the second horizontal plate in an unclamped position, the first horizontal plate in a fully clamped position, and the first and second hydraulic cylinders fully retracted.

FIG. 21 is a front view of the present invention shown with the second horizontal plate in an unclamped position, the first horizontal plate in a fully clamped position, and the first and second hydraulic cylinders fully retracted. In this position, the second horizontal plate 10 has now been moved back down so that it is closer to the first horizontal plate 9, where it will again clamp the polished rod 3 and move it upwards, as described previously.

Figure 22:
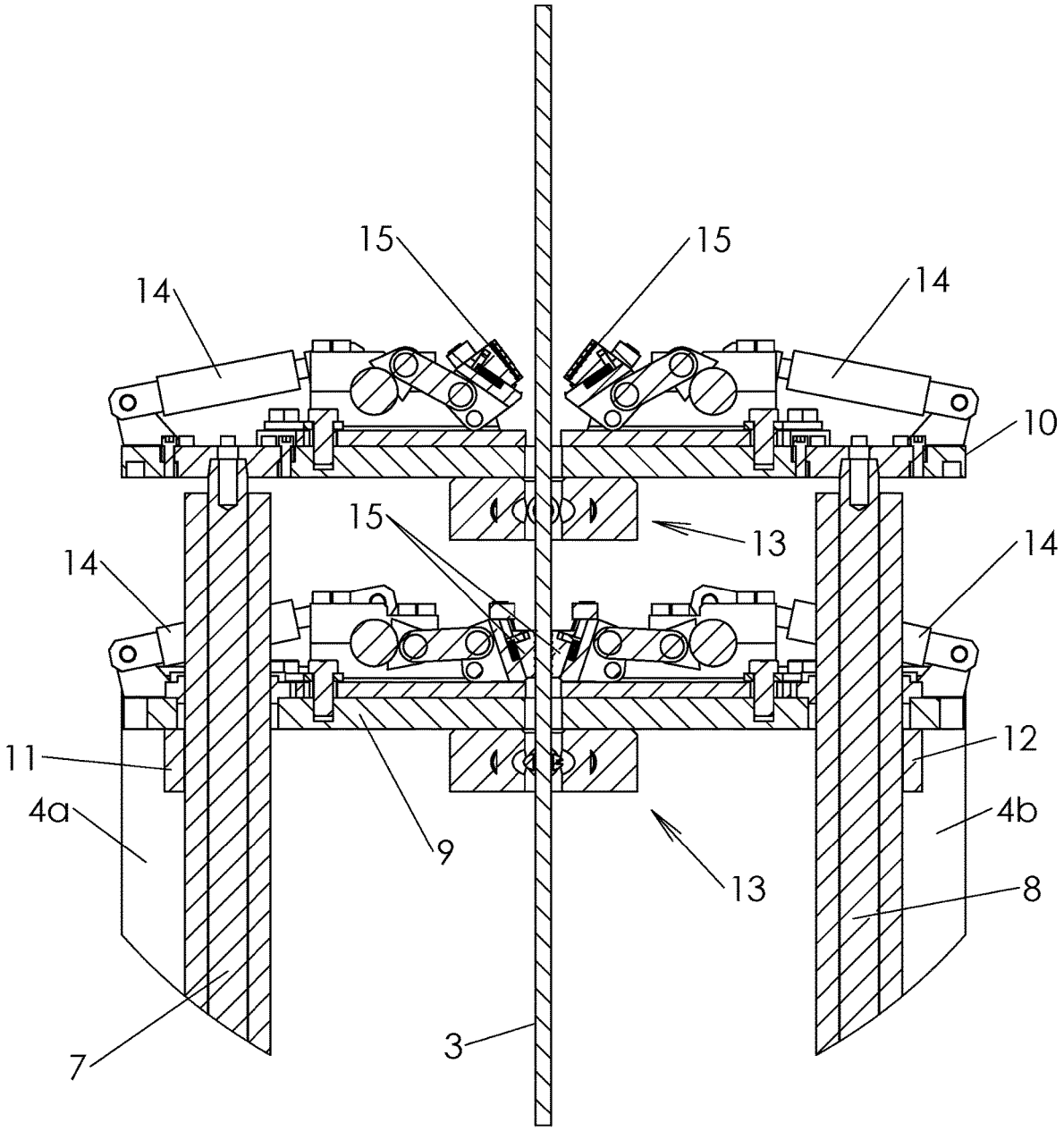
FIG. 22 is a section view of the present invention shown in FIG. 21 taken from the same perspective as FIG. 7.

FIG. 22 is a section view of the present invention shown in FIG. 21 taken from the same perspective as FIG. 7. In this figure, the polished rod 3 is still fully clamped by the first horizontal plate 9 according to the mechanism described above.

Figure 23:
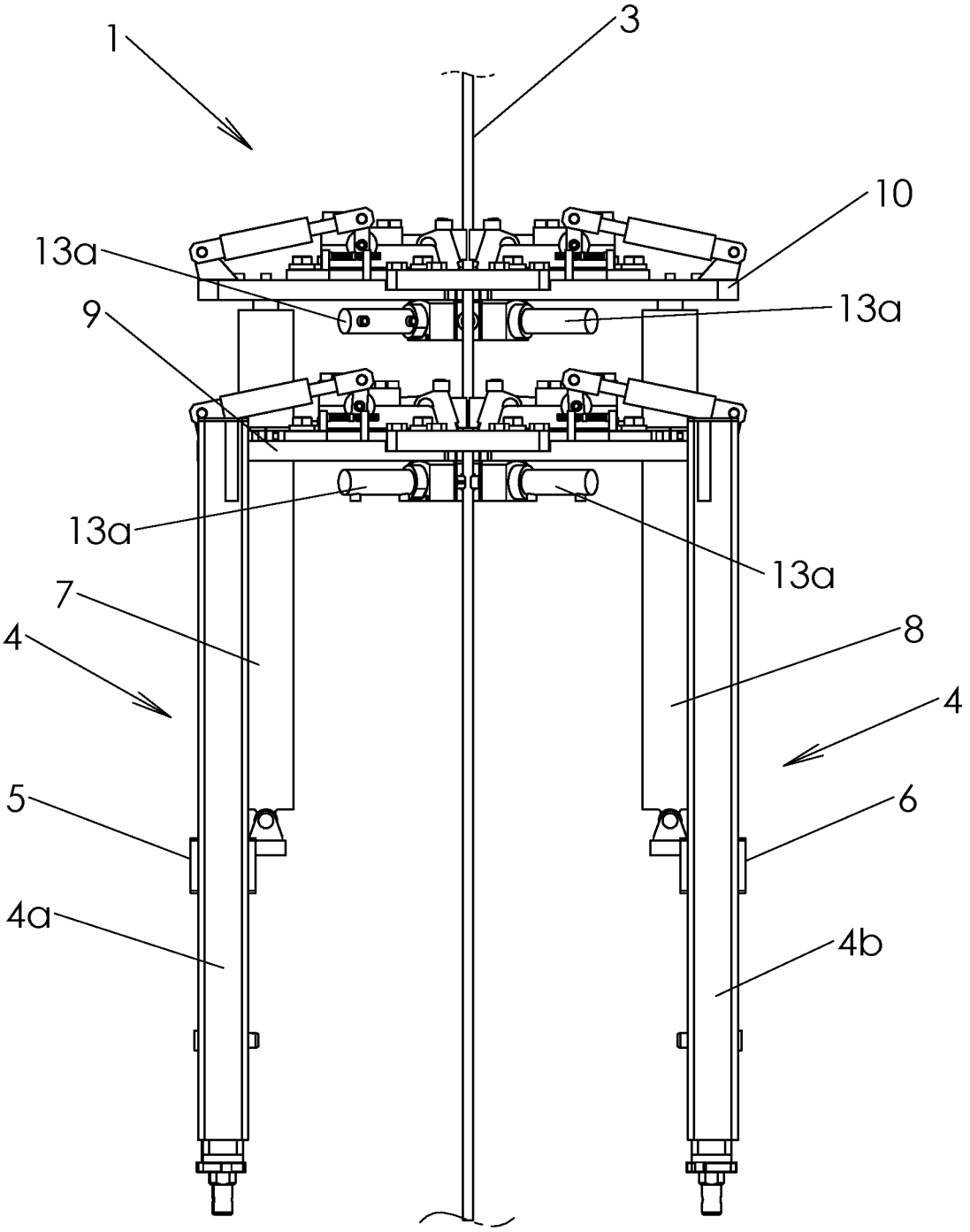
FIG. 23 is a front view of the present invention shown with the second horizontal plate in a first closed position, the first horizontal plate in a fully clamped position, and the first and second hydraulic cylinders fully retracted.
Figure 24:
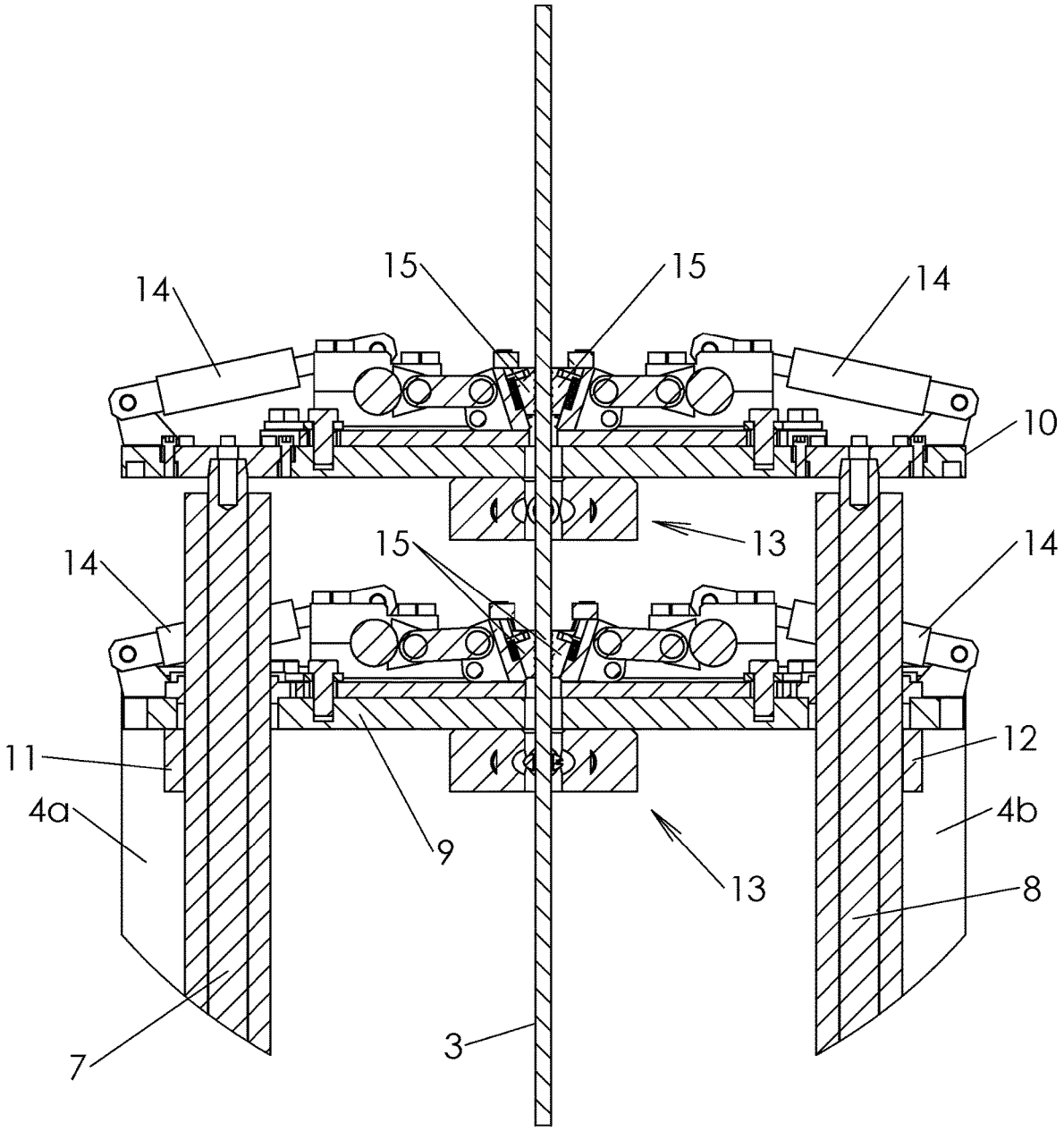
FIG. 24 is a section view of the present invention shown in FIG. 23 taken from the same perspective as FIG. 7.

FIG. 23 is a front view of the present invention shown with the second horizontal plate in a first closed position, the first horizontal plate in a fully clamped position, and the first and second hydraulic cylinders fully retracted. At this stage, the second horizontal plate 10 begins the clamping process, as described above (note the small gap 17 (see FIG. 24), which signifies the first stage of clamping), while the first horizontal plate 9 remains in a fully clamped position. The first horizontal plate will not release its clamped position until the second horizontal plate 10 is in a fully clamped position. Once the second horizontal plate 10 is in a fully clamped position and the first horizontal plate 9 has released its clamped position, the first and second hydraulic cylinders 7, 8 will once against be fully extended, repeating the process described above. In this manner, through repeated iterations of the clamping and unclamping process and the extension and retraction of the hydraulic cylinders 7, 8, the sucker rod assembly is gradually transported upwardly from within the well. Once the sucker rod assembly is in the desired position, a rod suspension tool may be moved in to suspend the rod string within the well.

Figure 25:
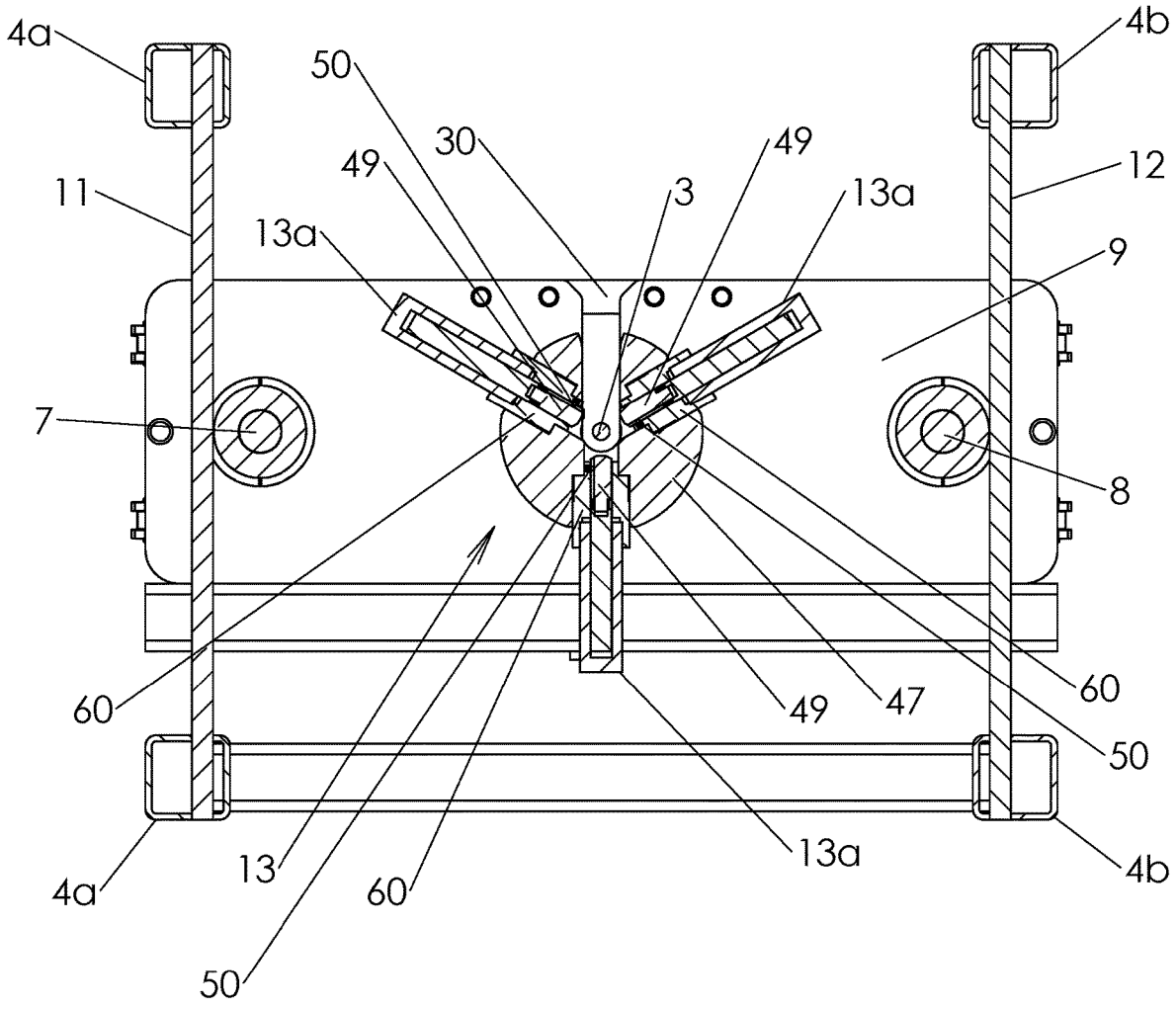
FIG. 25 is a section view of the secondary clamping assembly of the present invention shown in an open position.

FIG. 25 is a section view of the secondary clamping assembly of the present invention shown in an open position. As shown in this figure, the secondary clamping assembly 13 is comprised of three hydraulic cylinder 13*a*, arranged radically around the polished rod 3 on a C-plate 47 that is attached (preferably welded) to the center of the underside of the horizontal plate 9,10, as noted above. In this figure, the hydraulic cylinders 13*a* are retracted.

Figure 26:
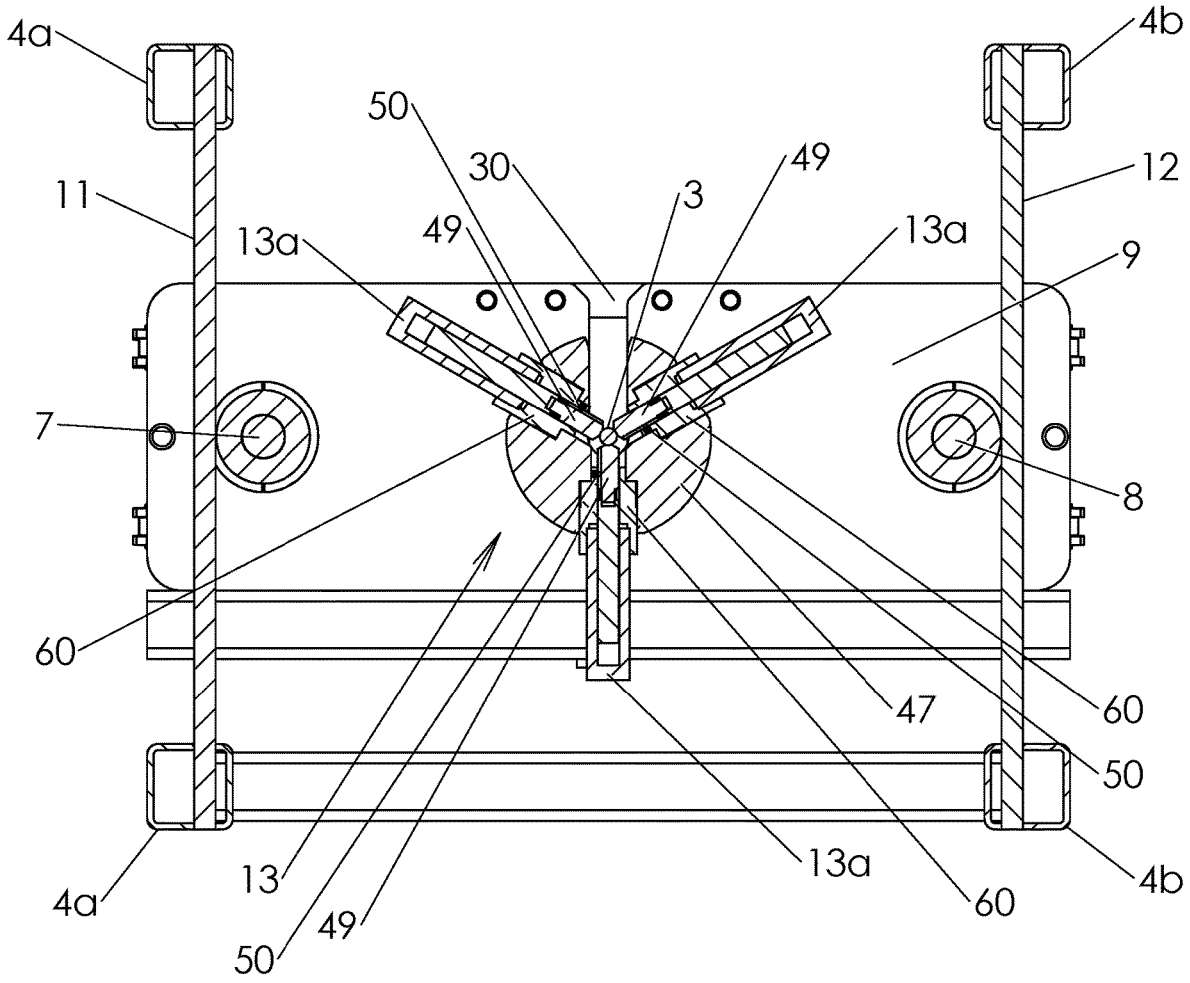
FIG. 26 is a section view of the secondary clamping assembly of the present invention shown in a closed position.

FIG. 26 is a section view of the secondary clamping assembly of the present invention shown in a closed position. In this figure, the dies 15 are closed around the polished rod 3, and the hydraulic cylinders 13*a* are extended so that each one comes into contact with and further secures in place the polished rod 3, thereby providing additional support to the primary clamping assembly and ensuring that the polished rod 3 is held both above (by the primary clamping assembly 16) and beneath (by the secondary clamping assembly 13) the horizontal plate 9,10.

Figure 27A:
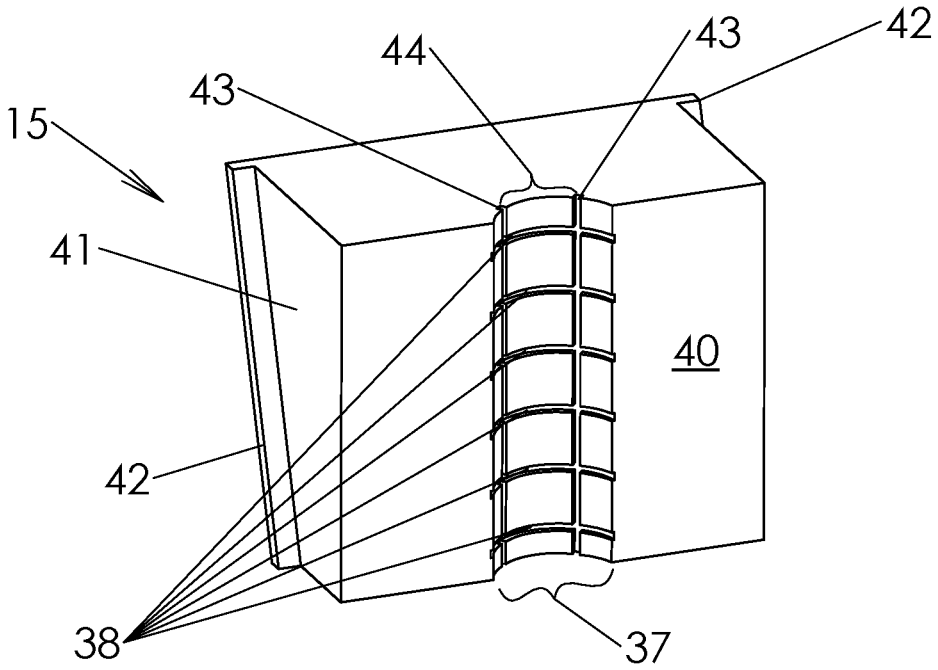
FIG. 27A is a front perspective view of the die of the present invention.

FIG. 27A is a front perspective view of the die of the present invention. As shown in this figure, the die 15 comprises a front surface 40 with a vertically oriented concave section 37. The concave section 37 preferably comprises a plurality of parallel grooves 38 extending laterally across the inside surface of the concave section 37 and two parallel grooves 43 extending longitudinally from the bottom of the die to the top of the die along the inside surface of the concave section 37. The two parallel grooves 43 are spaced apart to define an internal portion 44 of the concave section 37 of the die 15. The purpose of the grooves 38,43 is to facilitate gripping of the polished rod 3 by the die 15 and to provide an area (space) for the paraffins on the polished rod 3 to go when the polished rod 3 is squeezed by the dies 15. As shown, the die 15 further comprises a body that is trapezoidal in cross-section and right and left rear wings 42 (extending the full height of the die, from top to bottom) that facilitate insertion of the die 15 into the die housing 27 (see also FIG. 31).

Figure 27B:
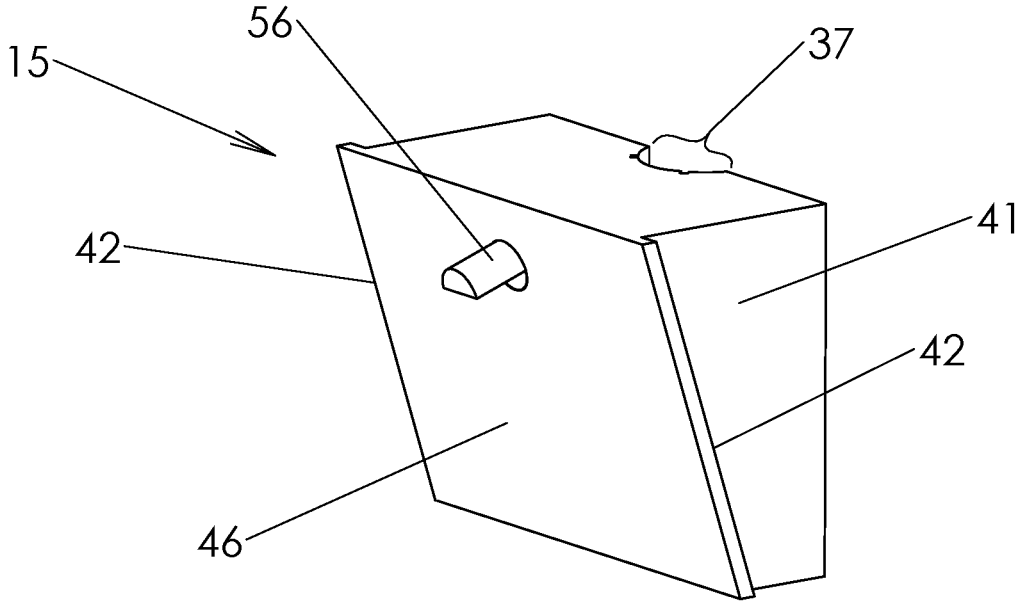
FIG. 27B is a rear perspective view of the die of the present invention.

FIG. 27B is a rear perspective view of the die of the present invention. As shown in this figure, the die 15 comprises a rearward extension 56 that is situated in an upper part of the die in the center (right-to-left) of the die. This extension 56 is also visible in FIGS. 29 and 30 and acts as a ceiling on the spring 45 that resides in the die housing 27 (see also FIG. 31).

Figure 28:
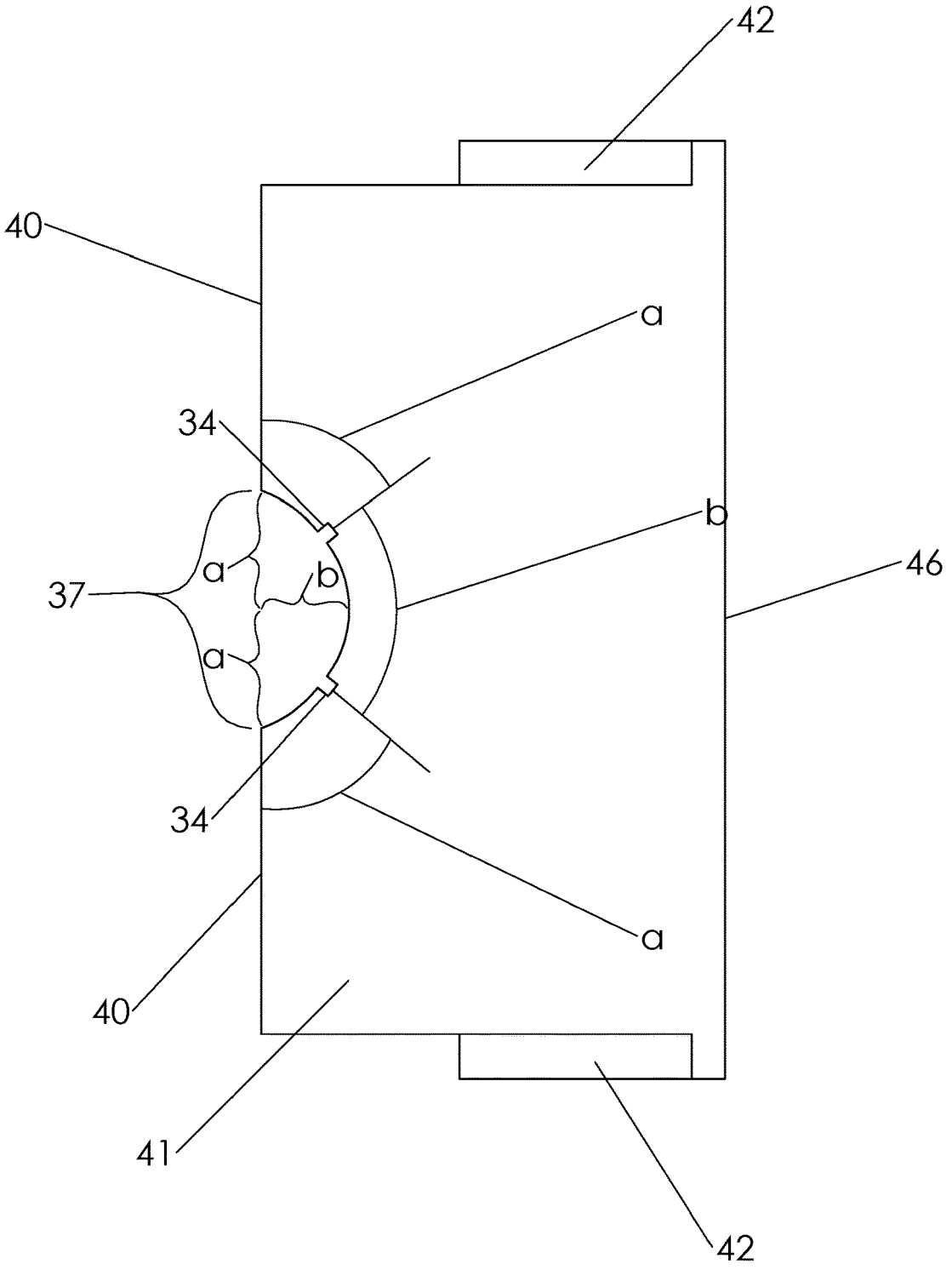
FIG. 28 is a top view of the die of the present invention.

FIG. 28 is a top view of the die of the present invention. In a preferred embodiment, the concave section 37 of the die 15 has a first radius (designated as "a" in FIG. 28) and a second radius (designated as "b" in FIG. 28). In a preferred embodiment, the first radius "a" is slightly greater than the second radius "b." As such, the concave section 37 of the die 15 is configured to squeeze two different sizes of polished rods 3—one with an outer diameter of ⅞ inch and one with an outer diameter of 1.0 inch.

Figure 29:
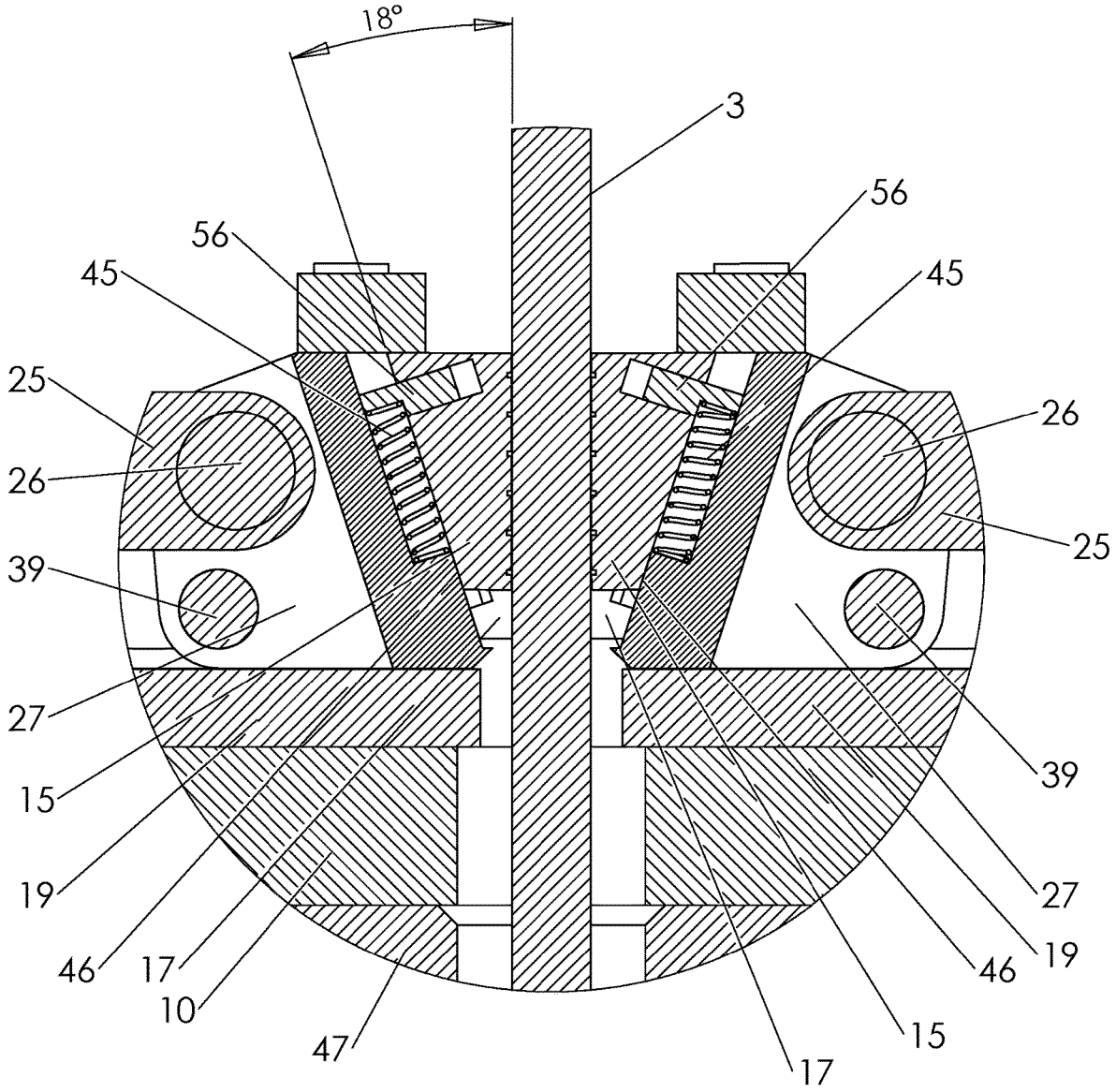
FIG. 29 is a section view of the dies shown in a first closed position.
Figure 30:
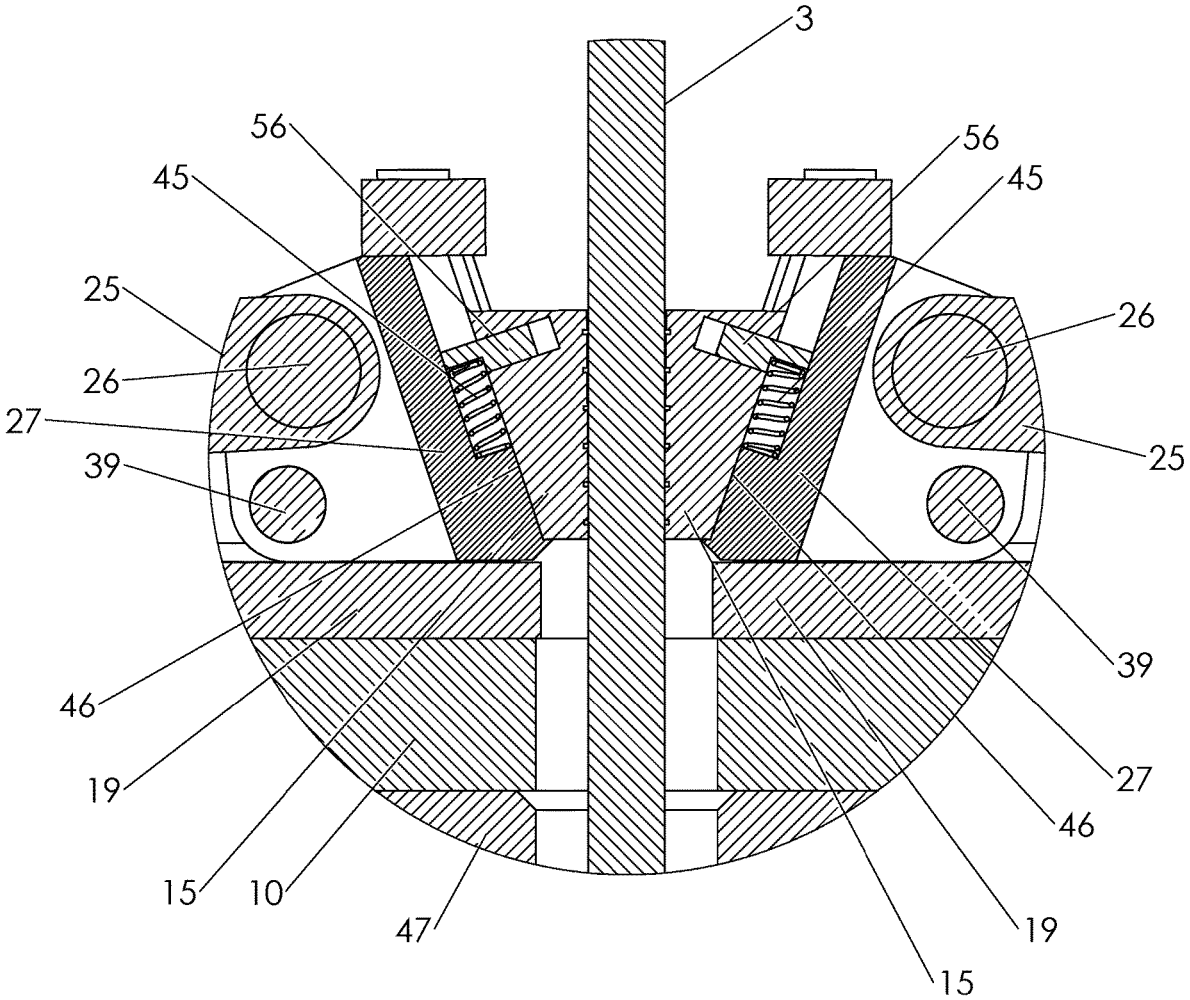
FIG. 30 is a section view of the dies shown in a second closed position.

FIG. 29 is a section view of the dies shown in a first closed position, and FIG. 30 is a section view of the dies shown in a second closed position. (FIG. 29 is a close-up of the top part of FIG. 10, and FIG. 30 is a close-up of the top part of FIG. 13.) As shown in these two figures, a spring 45 is preferably situated inside the die housing 27 and configured to bias the dies 15 in an upward position (thereby creating the gap 17) unless downward force is applied to the polished rod 3 or upward force is applied to the second horizontal plate 10, as described above, in which event such force overcomes the force of the spring 45 and pushes—by virtue of friction between the polished rod 3 and the concave section 37 of the dies 15—the dies into the downward position shown in FIG. 30, thereby compressing the spring 45. Once the primary clamping mechanism 16 is released, the spring 45 pushes the dies 15 back up into the position shown in FIG. 29. Note that the angle of the rear wall 46 of the die 15 determines the angle of the spring 45 relative to the polished rod 3 when the primary clamping assembly 16 is in a closed position. In a preferred embodiment, this angle is eighteen degrees (18°). This particular angle optimizes the forces between the dies 15 and the polished rod 3.

Figure 31:
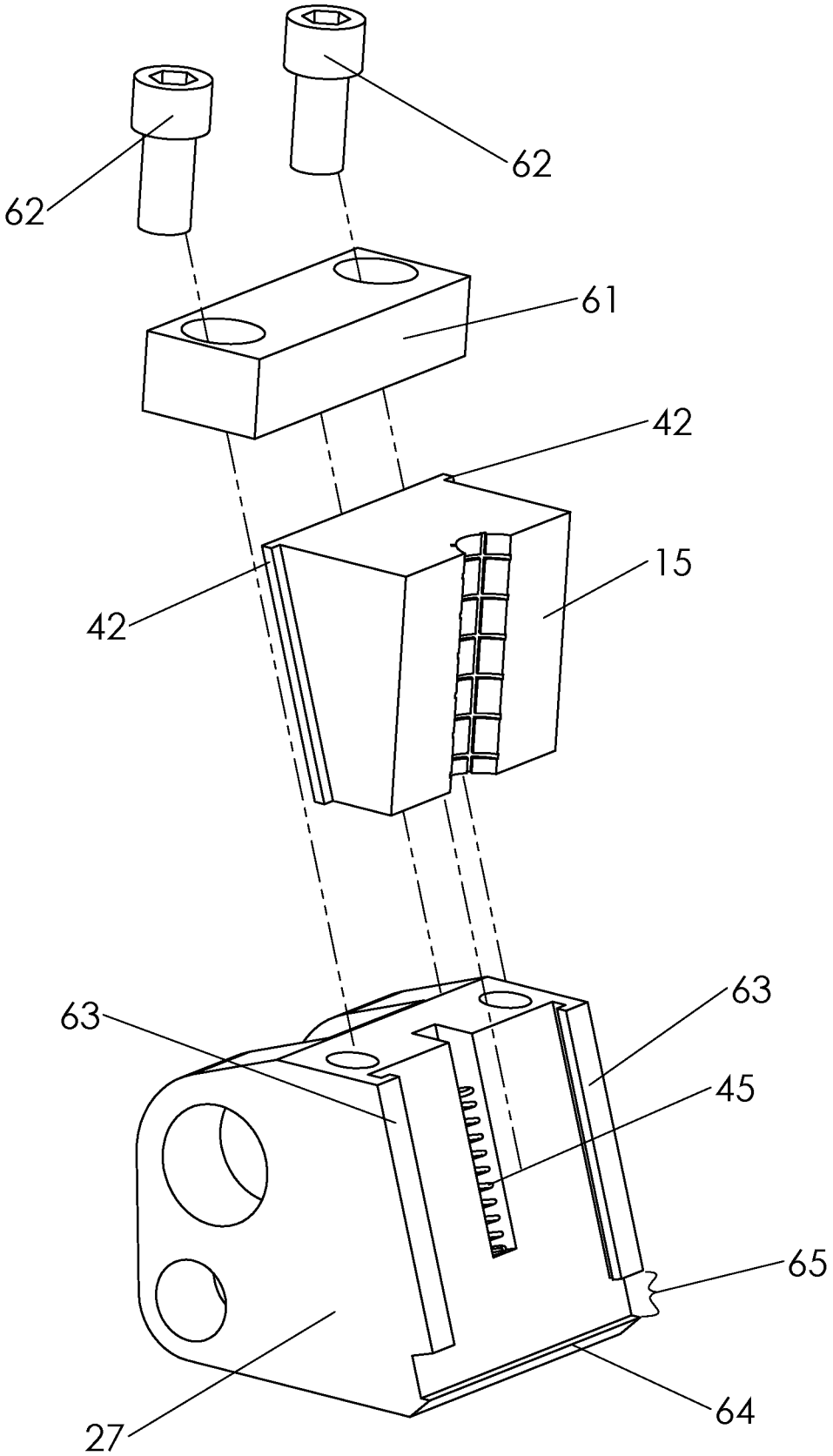
FIG. 31 is an exploded view of the die assembly of the present invention.

FIG. 31 is an exploded view of the die assembly of the present invention. As shown in this figure, the die assembly is comprised of the die 15, the die housing 27, a ceiling member 61 and two screws 62. The die housing 27 comprises two lips 63 that extend inward to create a channel into which the wings 42 on the die 15 are inserted (press fit). Note that the lips 63 are shorter than the wings 42 (measured top to bottom) and that the bottom ends of the wings 42 rest on top of the bottom beveled edge 64 of the die housing 27 when the die 15 is inserted into the die housing 27 (see also FIGS. 29 and 30). Once the die 15 is inserted into the die housing 27, the ceiling member 61 is positioned over the top of the die housing 27 and secured to the die housing with screws 62. To replace the die 15, the screws 62 and ceiling member 61 are removed, and the die is slid out of the die housing 27. The gap 65 between the bottom end of the lips 63 and the beveled edge 64 is designed to provide a place for debris to go so that it does not prevent the frill engagement of the slip assembly.

Although the preferred embodiment of the present invention has been shown and described, it will be apparent to those skilled in the art that many changes and modifications may be made without departing from the invention in its broader aspects. The appended claims are therefore intended to cover all such changes and modifications as fell within the true spirit and scope of the invention.

We claim:

1. A rod jack apparatus comprising:

(a) two vertical left legs and two vertical right legs configured to form a framework, each of the two vertical left legs and the two vertical right legs having an upper end;

(b) a first lower bracket situated horizontally between and connected to the two vertical left legs;

(c) a second lower bracket situated horizontally between and connected to the two vertical right legs;

(d) a first hydraulic cylinder extending upwardly from the first lower bracket;

(e) a second hydraulic cylinder extending upwardly from the second lower bracket;

(f) a first horizontal plate;

(g) a second horizontal plate;

wherein the first hydraulic cylinders has a top end that passes through an aperture in the first horizontal plate and is fixedly attached to the second horizontal plate;

wherein the first horizontal plate comprises a primary clamping assembly situated on top of the first horizontal plate and a secondary clamping assembly situated directly underneath the first horizontal plate, and the second horizontal plate comprises a primary clamping assembly situated on top of the second horizontal plate and a secondary clamping assembly situated directly underneath the second horizontal plate;

wherein the primary clamping assembly comprises a first pair of hydraulic cylinders oriented parallel to each other and situated on a left side of the first or second horizontal plate and a second pair of hydraulic cylinders oriented parallel to each other and situated on a right side of the first or second horizontal plate;

wherein each hydraulic cylinder on the first and second horizonal plates is mechanically coupled via one or more linkages to a first die having a front surface with a concave section, the first die being configured to clamp around a polished rod when the hydraulic cylinders are extended; and wherein the secondary clamping assembly comprises a C-plate configured to receive the polished rod and at least two hydraulic cylinders arranged radially around a center of the C-plate.

2. The rod jack apparatus of claim 1, further comprising:

a first upper bracket that is situated horizontally between and connected to the upper ends of the two vertical left legs; and a second upper bracket that is situated horizontally between and connected to the upper ends of the two vertical right legs;

wherein the second horizontal plate has left and right ends that are supported by the first and second upper brackets, respectively.

3. The rod jack apparatus of claim 1, wherein a second die having a front surface with a concave section is attached to a distal end of a piston rod of each of the at least two hydraulic cylinders of the secondary clamping assembly.

4. The rod jack apparatus of claim 1, wherein each of the first and second horizontal plates comprises:

a central channel that extends from a front to a center of the first or second horizontal plate; and a front recess that spans the central channel and is configured to receive a removable bracket.

5. The rod jack apparatus of claim 1, further comprising a first platform situated directly on top of the first horizontal plate and a second platform situated directly on top of the second horizontal plate;

wherein the first platform is configured to move from a first position relative to the first horizontal plate to a second position relative to the first horizontal plate, and the second platform is configured to move from a first position relative to the second horizontal plate to a second position relative to the second horizontal plate;

wherein when the first platform is in the second position, the first platform is closer to the polished rod than when the first platform is in the first position, and when the second platform is in the second position, the second platform is closer to the polished rod than when the second platform is in the first position;

wherein each first die resides within a die housing;

wherein the one or more linkages are configured so that the first die and die housing tilt forward toward the polished rod and the platform moves from the first position to the second position when the primary clamping assembly is activated; and wherein a first spring pushes the platform back to the first position when the primary clamping mechanism is inactivated.

6. The rod jack apparatus of claim 5, further comprising a second spring that is situated inside the die housing and configured to bias the first die in an upward position when the first die is inserted into the die housing.

7. The rod jack apparatus of claim 5, wherein the die housing comprises a first lip along a right front edge of the die housing and a second lip along a left front edge of the die housing; each of the first and second lips extending inward to form a channel;

wherein the first die comprises right and left rear wings;

wherein the first and second lips on the die housing and configured to receive the right and left rear wings on the first die;

wherein the die housing further comprises a bottom beveled edge; and wherein the first and second lips are shorter than the right and left wings so as to form a gap between a bottom end of each of the first and second lips and the bottom beveled edge of the die housing.

8. The rod jack apparatus of claim 1, wherein the concave section on the front surface of the first die has a first radius and a second radius, and wherein the first radius is greater than the second radius.

9. The rod jack apparatus of claim 1, wherein the concave section on the front surface of the first die comprises:

a plurality of parallel grooves extending laterally across an inside surface of the concave section; and two parallel grooves extending longitudinally from a bottom of the first die to a top of the first die along the inside surface of the concave section.

10. The rod jack apparatus of claim 1, wherein the first die comprises a rear wall;

wherein the front surface of the first die comprises a flat section on either side of the concave section; and wherein the rear wall of the first die is at an eighteen-degree angle relative to the flat section of the front surface of the first die.

11. A method of lifting a sucker rod assembly from a wellbore; comprising the steps of:

(a) installing the rod jack apparatus of claim 1 over a wellbore;

(b) activating the primary clamping assembly on the second horizontal plate;

(c) activating the secondary clamping assembly on the second horizontal plate;

(d) extending the first and second hydraulic cylinders;

(e) activating the primary clamping assembly on the first horizontal plate;

(f) activating the secondary clamping assembly on the first horizontal plate;

(g) releasing the primary and secondary clamping assemblies on the second horizontal plate;

(h) retracting the first and second hydraulic cylinders;

(i) repeating steps (b) and (c);

(j) releasing the primary and secondary clamping assemblies of the first horizontal plate; and (k) repeating steps (d) through (h).

* * * * *